US011191995B2

(12) United States Patent
Anderson et al.

(10) Patent No.: US 11,191,995 B2
(45) Date of Patent: Dec. 7, 2021

(54) PEDAL ASSEMBLY FOR EXERCISE MACHINE

(71) Applicant: NAUTILUS, INC., Vancouver, WA (US)

(72) Inventors: Todd D. Anderson, Vancouver, WA (US); Marcus L. Marjama, Vancouver, WA (US); Benjamin A. Browning, Vancouver, WA (US)

(73) Assignee: Nautilus, Inc., Vancouver, WA (US)

( * ) Notice: Subject to any disclaimer, the term of this patent is extended or adjusted under 35 U.S.C. 154(b) by 39 days.

(21) Appl. No.: 16/450,681

(22) Filed: Jun. 24, 2019

(65) Prior Publication Data

US 2019/0308062 A1 Oct. 10, 2019

Related U.S. Application Data

(63) Continuation of application No. 15/633,698, filed on Jun. 26, 2017, now Pat. No. 10,328,301.
(Continued)

(51) Int. Cl.
*A63B 22/00* (2006.01)
*A63B 23/035* (2006.01)
(Continued)

(52) U.S. Cl.
CPC ..... *A63B 22/0015* (2013.01); *A63B 21/0051* (2013.01); *A63B 21/00069* (2013.01);
(Continued)

(58) Field of Classification Search
CPC ..... A63B 22/0015; A63B 21/0088; A63B 22/205; A63B 71/0619; A63B 23/03575;
(Continued)

(56) References Cited

U.S. PATENT DOCUMENTS 3,563,129 A 2/1971 Cantrell
3,628,791 A 12/1971 Garcia
(Continued)

FOREIGN PATENT DOCUMENTS

CN 2629764 Y 8/2004
CN 204637443 U 9/2015
(Continued)

OTHER PUBLICATIONS

"NordicTrack E7.7 Power Incline User Manual", 2013, 32 pages.
"NordicTrack E9.5 User Manual", 2012, 36 pages.
"Spirit Elliptical User Manual", Oct. 1, 2007, 45 pages.

*Primary Examiner* — Andrew S Lo
(74) *Attorney, Agent, or Firm* — Dorsey & Whitney LLP

(57) ABSTRACT

A stationary exercise machine according to the present disclosure may include a frame, a crankshaft rotatably supported by the frame, first and second lower linkages, and first and second crank arms connected to opposite sides of the crankshaft such that rotation of either of the crank arms causes rotation of the crankshaft. The lower linkages may be operatively connected to the crankshaft and to a respective one of first and second pedals. Each of the lower linkages may include a reciprocating member operatively connecting one of the pedals with one of the crank arms. Each of the lower linkages may include an adjustable linkage connected between the reciprocating member and the respective crank arm, the adjustable linkage may vary a distance between an output end of the reciprocating member and an input end of the crank arm. Each of the pedals may be pivotally connected to the respective reciprocating members.

20 Claims, 31 Drawing Sheets

Related U.S. Application Data

(60) Provisional application No. 62/440,878, filed on Dec. 30, 2016.

(51) Int. Cl.

| | |
|---|---|
| ***A63B 21/00*** | (2006.01) |
| ***A63B 21/012*** | (2006.01) |
| ***A63B 22/06*** | (2006.01) |
| ***A63B 22/20*** | (2006.01) |
| ***A63B 21/005*** | (2006.01) |
| ***A63B 21/008*** | (2006.01) |
| ***A63B 71/06*** | (2006.01) |
| *A63B 71/00* | (2006.01) |

(52) U.S. Cl.

CPC .... *A63B 21/00076* (2013.01); *A63B 21/0088* (2013.01); *A63B 21/012* (2013.01); *A63B 21/154* (2013.01); *A63B 21/4034* (2015.10); *A63B 21/4035* (2015.10); *A63B 21/4045* (2015.10); *A63B 22/001* (2013.01); *A63B 22/0017* (2015.10); *A63B 22/0664* (2013.01); *A63B 22/205* (2013.01); *A63B 23/03575* (2013.01); *A63B 23/03583* (2013.01); *A63B 71/0619* (2013.01); *A63B 21/005* (2013.01); *A63B 2022/0676* (2013.01); *A63B 2071/009* (2013.01); *A63B 2225/09* (2013.01)

(58) Field of Classification Search

CPC ..... A63B 21/4035; A63B 21/4045; A63B 21/00069; A63B 21/0076; A63B 21/0051; A63B 21/4034; A63B 21/012; A63B 21/154; A63B 22/001; A63B 22/0017; A63B 22/0664; A63B 23/03583; A63B 2022/0676; A63B 21/005; A63B 2225/09

See application file for complete search history.

(56) References Cited

U.S. PATENT DOCUMENTS

RE30,758 E 10/1981 Lang
4,502,680 A 3/1985 Blum et al.
4,599,915 A * 7/1986 Hlavac ..... B62M 3/08 74/594.4
4,842,269 A * 6/1989 Huang ..... A63B 22/0002 482/115
4,973,046 A * 11/1990 Maxwell ..... A63B 21/00178 482/60
5,020,793 A 6/1991 Loane
5,044,627 A * 9/1991 Huang ..... A63B 22/0005 482/62
5,069,445 A 12/1991 Mai
5,147,257 A 9/1992 Loane
5,336,141 A 8/1994 Vittone
5,336,142 A 8/1994 Dalebout et al.
5,429,563 A 7/1995 Engel et al.
5,449,332 A * 9/1995 Hervig ..... A63B 22/0046 482/57
5,499,956 A 3/1996 Habing et al.
5,503,607 A * 4/1996 Lo ..... A63B 21/157 482/52
5,628,710 A * 5/1997 Hervig ..... A63B 22/0046 482/57
D383,813 S 9/1997 Zoller
5,683,331 A 11/1997 Dalebout
5,690,589 A 11/1997 Rodgers, Jr.
5,749,811 A 5/1998 Wilson
5,901,617 A * 5/1999 Hervig ..... B62M 3/08 74/594.4
5,919,118 A 7/1999 Stearns et al.
5,921,894 A 7/1999 Eschenbach
6,003,408 A * 12/1999 Hervig ..... B62M 3/08 482/57
6,042,512 A 3/2000 Eschenbach
6,090,014 A 7/2000 Eschenbach
6,123,650 A 9/2000 Birrell
6,132,340 A 10/2000 Wang et al.
6,146,313 A 11/2000 Whan-Tong et al.
6,241,639 B1 * 6/2001 Hervig ..... A63B 22/0046 482/57
6,277,055 B1 8/2001 Birrell et al.
6,422,977 B1 7/2002 Eschenbach
6,440,042 B2 8/2002 Eschenbach
6,485,395 B1 * 11/2002 Stearns ..... A63B 22/001 482/52
6,500,096 B1 12/2002 Farney
6,569,213 B1 * 5/2003 Busch ..... A63B 21/026 48/79
6,688,192 B1 * 2/2004 Badarneh ..... A63B 22/16 74/594.4
6,783,481 B2 8/2004 Stearns et al.
6,821,232 B1 11/2004 Wang et al.
6,849,034 B2 2/2005 Eschenbach
6,875,160 B2 4/2005 Watterson et al.
6,939,271 B1 9/2005 Whan-Tong et al.
7,037,242 B2 5/2006 Lo et al.
7,169,087 B2 1/2007 Ercanbrack et al.
7,207,930 B2 4/2007 Bonutti
7,244,218 B1 * 7/2007 Lin ..... A63B 22/001 482/52
7,276,017 B2 10/2007 Chen
7,300,387 B2 11/2007 Wang
7,316,633 B2 1/2008 Liao et al.
7,377,879 B1 5/2008 Chen
7,425,188 B2 9/2008 Ercanbrack et al.
7,604,573 B2 10/2009 Dalebout et al.
7,618,350 B2 11/2009 Dalebout et al.
7,645,215 B2 1/2010 Gordon
7,665,388 B2 2/2010 Chen
7,666,122 B2 2/2010 Chiles et al.
7,674,205 B2 3/2010 Dalebout et al.
7,691,035 B2 4/2010 Chen et al.
7,727,120 B2 6/2010 Smith
7,771,324 B2 8/2010 Anderson et al.
7,803,089 B2 9/2010 Roimicher et al.
7,909,739 B2 3/2011 Kwon et al.
8,079,937 B2 12/2011 Bedell et al.
8,734,298 B2 5/2014 Murray
8,808,149 B2 8/2014 Huang
8,894,549 B2 11/2014 Colledge
9,259,610 B2 2/2016 Huang et al.
9,457,224 B2 10/2016 Giannelli et al.
9,511,255 B1 12/2016 Miller
9,586,086 B2 3/2017 Dalebout et al.
9,868,016 B2 1/2018 Meredith et al.
9,950,765 B2 * 4/2018 Goulet ..... B62M 3/00
10,010,756 B2 7/2018 Watterson
10,022,587 B1 * 7/2018 Wu ..... A61H 1/005
2002/0198084 A1 12/2002 Stearns et al.
2004/0157706 A1 8/2004 Miller
2004/0259692 A1 * 12/2004 Martin ..... A63B 22/0007 482/52
2004/0266588 A1 12/2004 Miller
2005/0003932 A1 * 1/2005 Chen ..... A63B 22/001 482/52
2005/0043148 A1 * 2/2005 Maresh ..... A63B 22/0017 482/70
2005/0181911 A1 8/2005 Porth
2005/0288155 A1 12/2005 Yang
2006/0199702 A1 9/2006 Eschenbach
2006/0247103 A1 11/2006 Stearns et al.
2006/0252607 A1 * 11/2006 Holloway ..... A63B 22/0605 482/62
2006/0276311 A1 * 12/2006 Martin ..... A63B 21/0552 482/92
2007/0072742 A1 * 3/2007 Chen ..... A63B 22/001 482/52
2007/0135268 A1 6/2007 Wang
2007/0135269 A1 6/2007 Wang
2007/0219060 A1 9/2007 Liang

(56) References Cited

U.S. PATENT DOCUMENTS

| | | | | |
|---|---|---|---|---|
| 2007/0270290 | A1* | 11/2007 | Mosimann | A63B 21/4047 482/100 |
| 2007/0293375 | A1* | 12/2007 | Nguyen | A63B 21/4029 482/60 |
| 2008/0064571 | A1 | 3/2008 | Lee | |
| 2008/0161166 | A1 | 7/2008 | Lo | |
| 2008/0207416 | A1* | 8/2008 | Roimicher | B62M 3/08 482/148 |
| 2008/0280733 | A1 | 11/2008 | Dickie et al. | |
| 2009/0011904 | A1 | 1/2009 | Chuang et al. | |
| 2009/0209394 | A1 | 8/2009 | Kwon et al. | |
| 2010/0152001 | A1 | 6/2010 | Gordon | |
| 2011/0275487 | A1 | 11/2011 | Richards et al. | |
| 2012/0115685 | A1 | 5/2012 | Bedell et al. | |
| 2013/0190136 | A1 | 7/2013 | Watterson | |
| 2014/0051552 | A1 | 2/2014 | Habing et al. | |
| 2014/0249000 | A1 | 9/2014 | Lu et al. | |
| 2014/0274573 | A1 | 9/2014 | Chang et al. | |
| 2014/0274574 | A1 | 9/2014 | Shorten et al. | |
| 2014/0274575 | A1 | 9/2014 | Yim et al. | |
| 2016/0008658 | A1 | 1/2016 | Yim et al. | |
| 2016/0158595 | A1 | 6/2016 | Dalebout | |
| 2016/0296790 | A1 | 10/2016 | Chuang et al. | |
| 2016/0339288 | A1 | 11/2016 | Li | |
| 2016/0375300 | A1 | 12/2016 | Chang et al. | |
| 2017/0001066 | A1 | 1/2017 | Long | |
| 2017/0056709 | A1 | 3/2017 | Ercanbrack et al. | |
| 2017/0056717 | A1 | 3/2017 | Ercanbrack et al. | |
| 2017/0216660 | A1 | 8/2017 | Lernihan | |
| 2017/0266481 | A1 | 9/2017 | Dalebout | |
| 2018/0050231 | A1 | 2/2018 | Teal et al. | |

FOREIGN PATENT DOCUMENTS

| | | | |
|---|---|---|---|
| CN | 108697919 | A | 10/2018 |
| EP | 1557199 | A2 | 7/2005 |
| KR | 20050115148 | A | 12/2005 |
| WO | 2008114292 | A1 | 9/2008 |
| WO | 2018125840 | A1 | 7/2018 |

* cited by examiner

PEDAL ASSEMBLY FOR EXERCISE MACHINE

CROSS REFERENCE TO RELATED APPLICATIONS

This application is a continuation of U.S. patent application Ser. No. 15/633,698, filed Jun. 26, 2017, entitled "EXERCISE MACHINE WITH ADJUSTABLE STRIDE,", which claims benefit under 35 U.S.C. § 119 of the earlier filing date of U.S. Provisional Application No. 62/440,878, filed Dec. 30, 2016, entitled "EXERCISE MACHINE WITH ADJUSTABLE STRIDE," which are both hereby incorporated herein by reference in their entireties for all purposes.

BACKGROUND

Certain stationary exercise machines with reciprocating leg and/or arm portions have been developed. Such stationary exercise machines include stair climbers and elliptical trainers, each of which typically offers a different type of workout. For example, a stair climber may provide a lower frequency vertical climbing simulation while an elliptical trainer may provide a higher frequency horizontal running simulation. Additionally, these machines may include handles that provide support for the user's arms during exercise. However, the connections between the handles and leg portions of traditional stationary exercise machines may not enable sufficient exercise of the user's upper body. Also, existing stationary exercise machines typically have minimal adjustability mainly limited to adjusting the amount of resistance applied to the reciprocating leg portions. It may therefore be desirable to provide an improved stationary exercise machine which addresses one or more of the problems in the field and which generally improves the user experience.

BRIEF DESCRIPTION OF THE DRAWINGS

The description will be more fully understood with reference to the following figures in which components may not be drawn to scale, which are presented as various embodiments of the exercise machine described herein and should not be construed as a complete depiction of the scope of the exercise machine.

DETAILED DESCRIPTION

Figure 1:
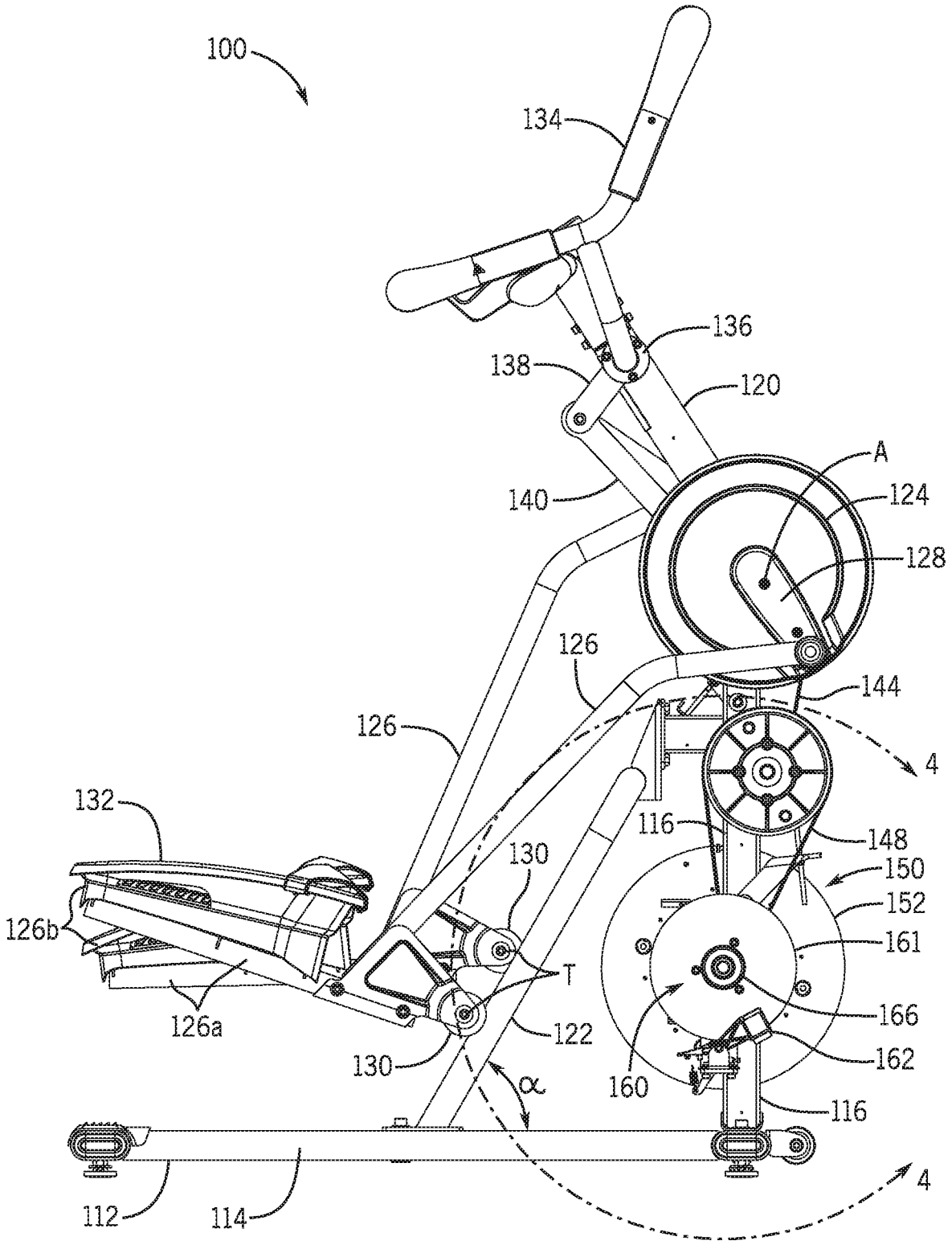
FIG. 1 is a right side view of an exemplary exercise machine.
Figure 2A:
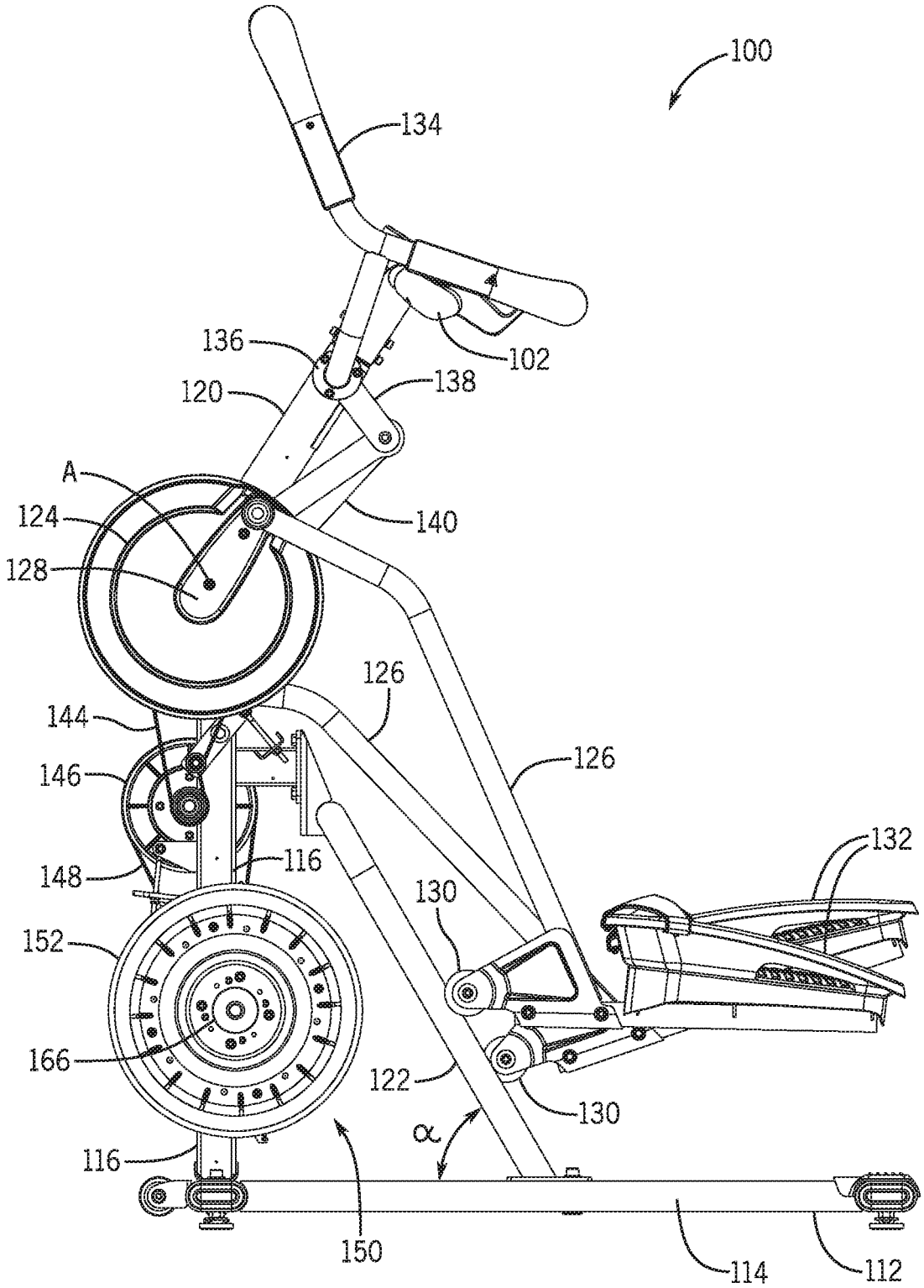
FIG. 2A is a left side view of the machine of FIG. 1.
Figure 2B:
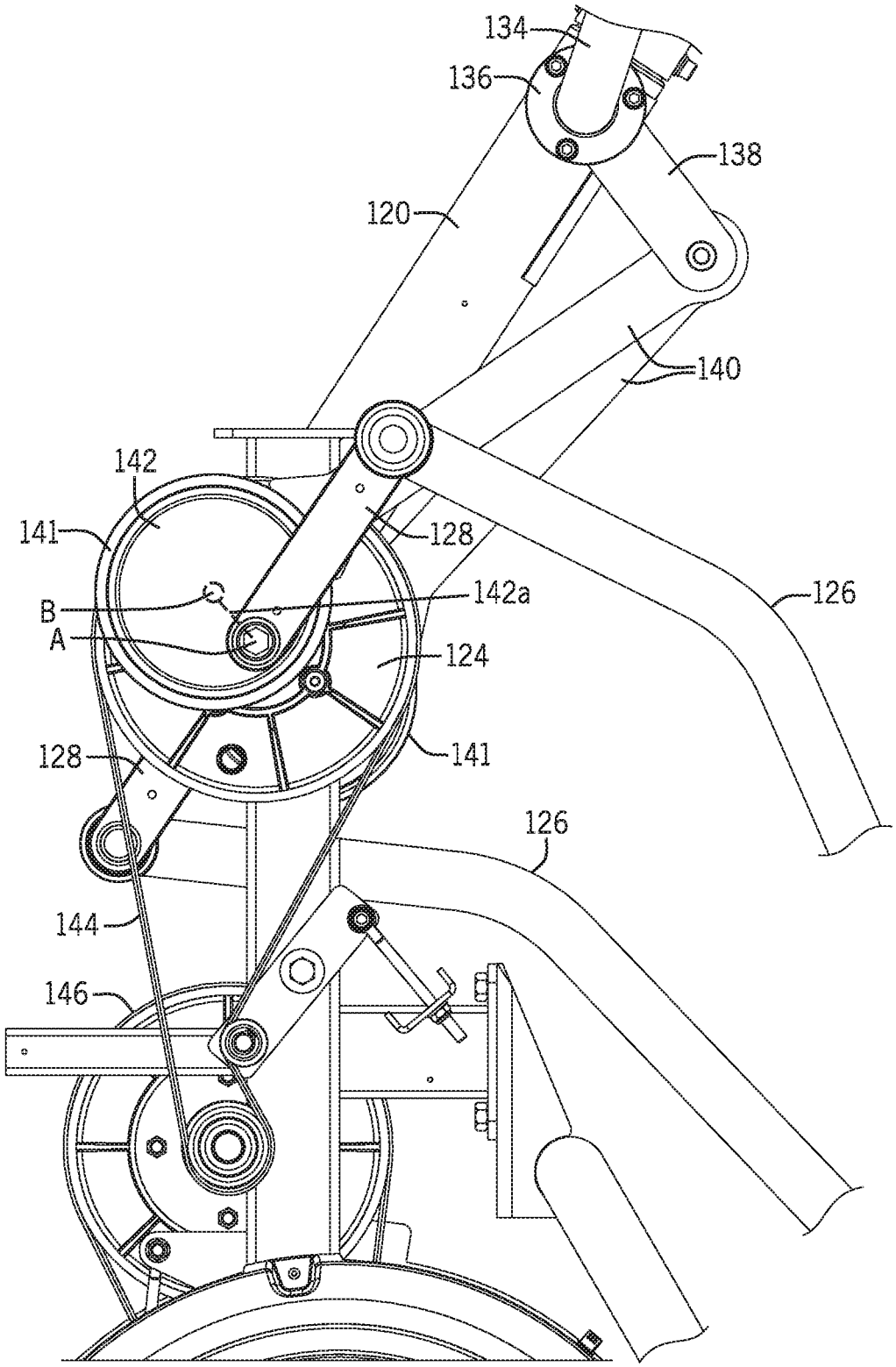
FIGS. 2B-2G are partial, in some cases simplified, views of the machine of FIG. 1.
Figure 2C:
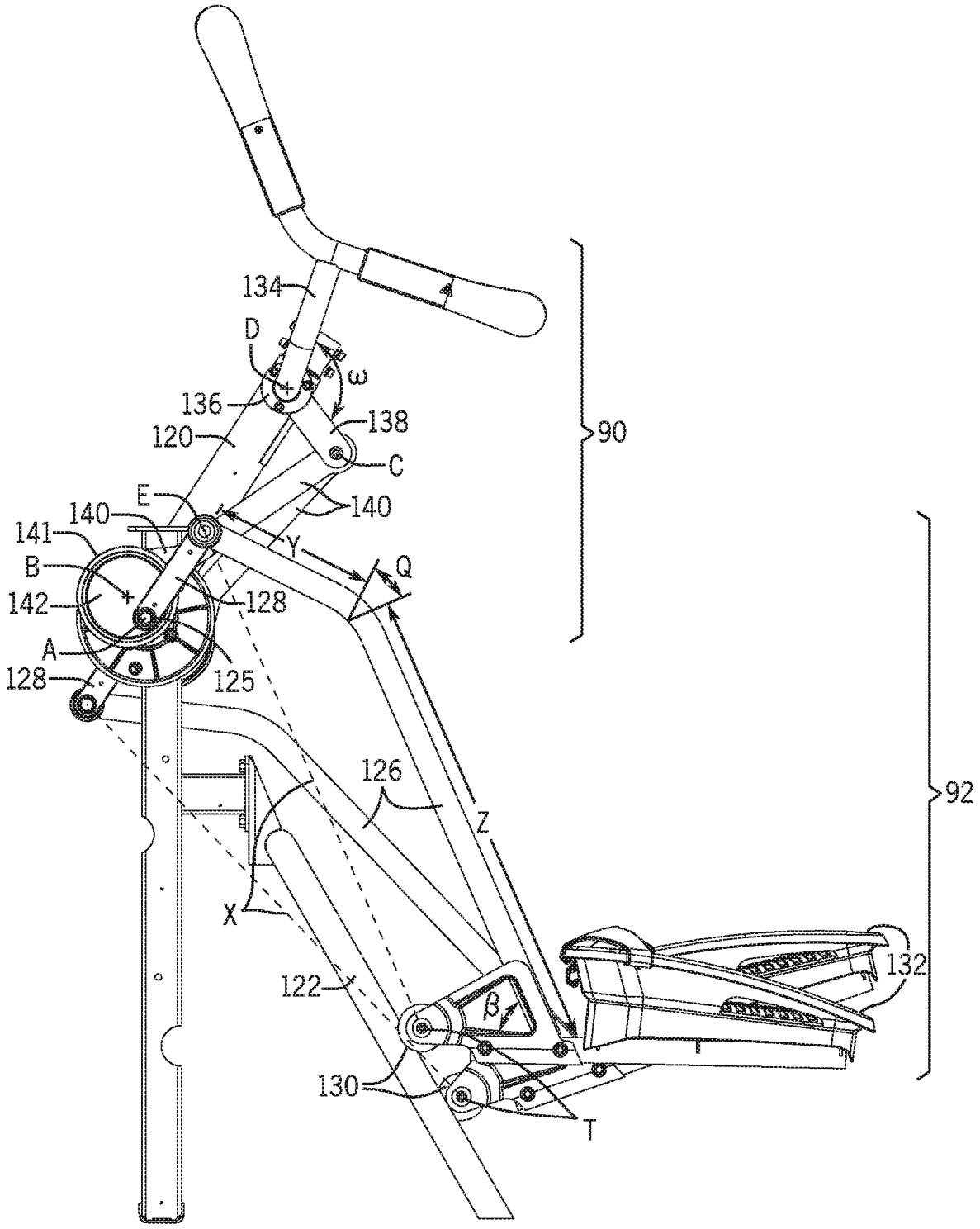
Figure 2D:
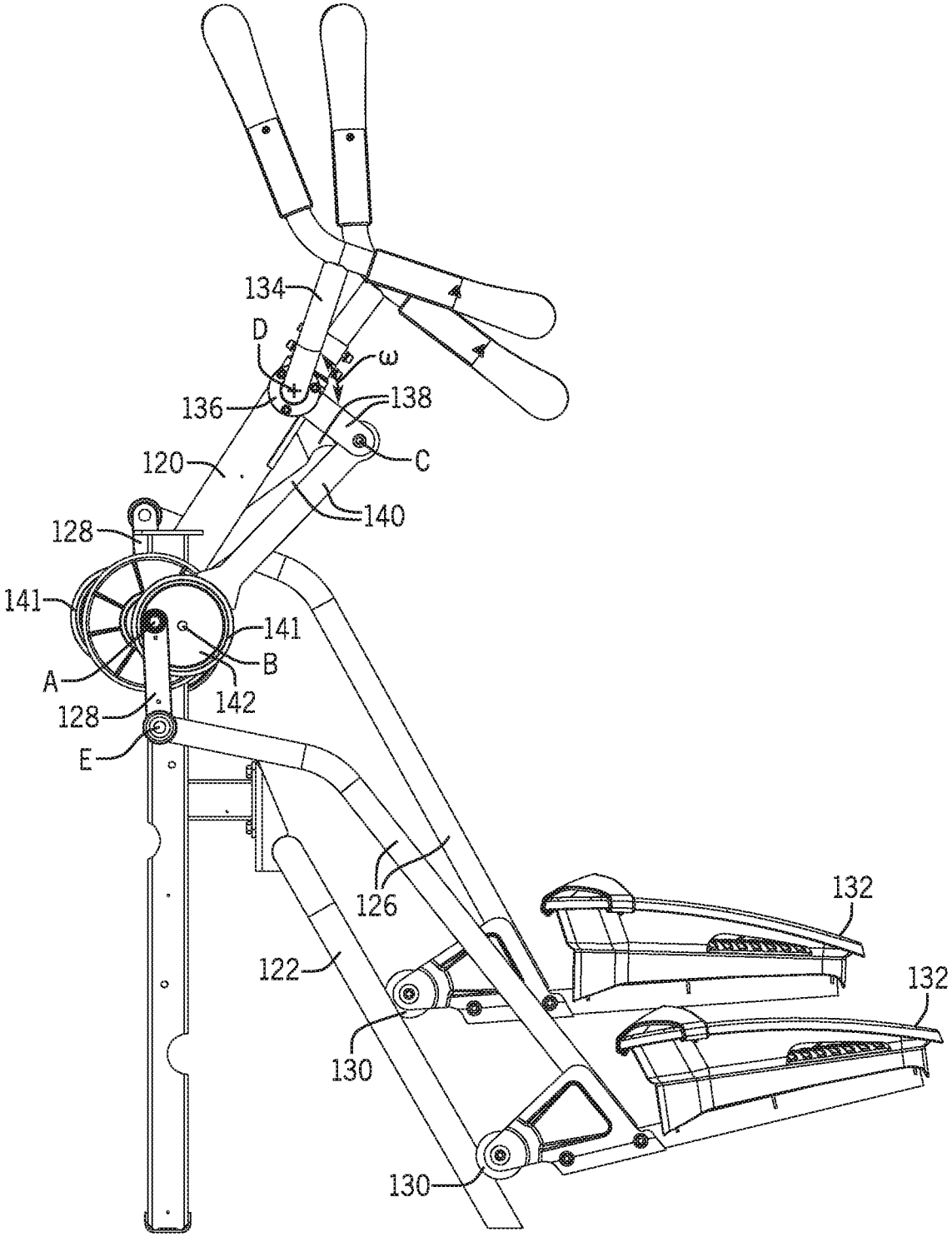
Figure 2E:
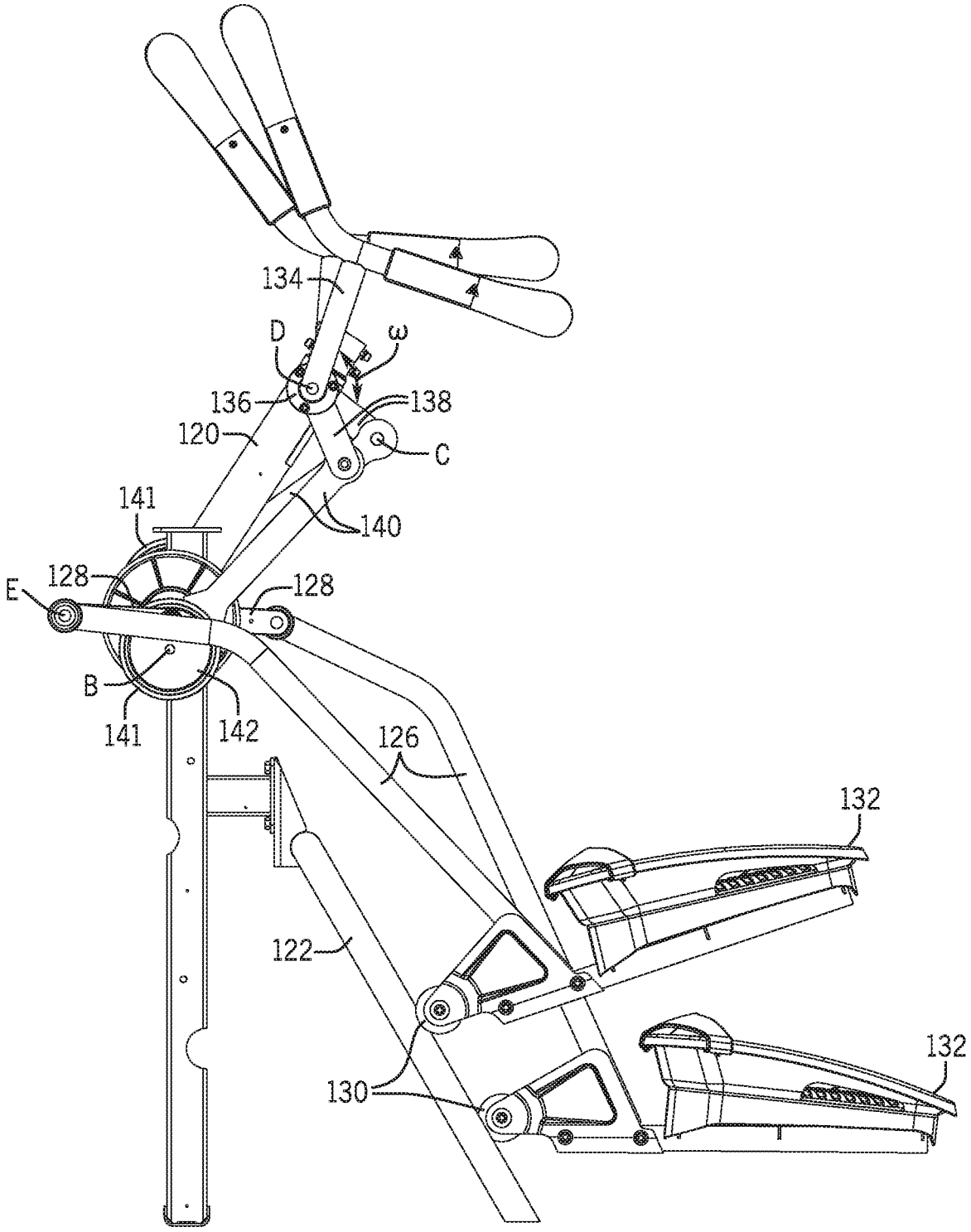
Figure 2F:
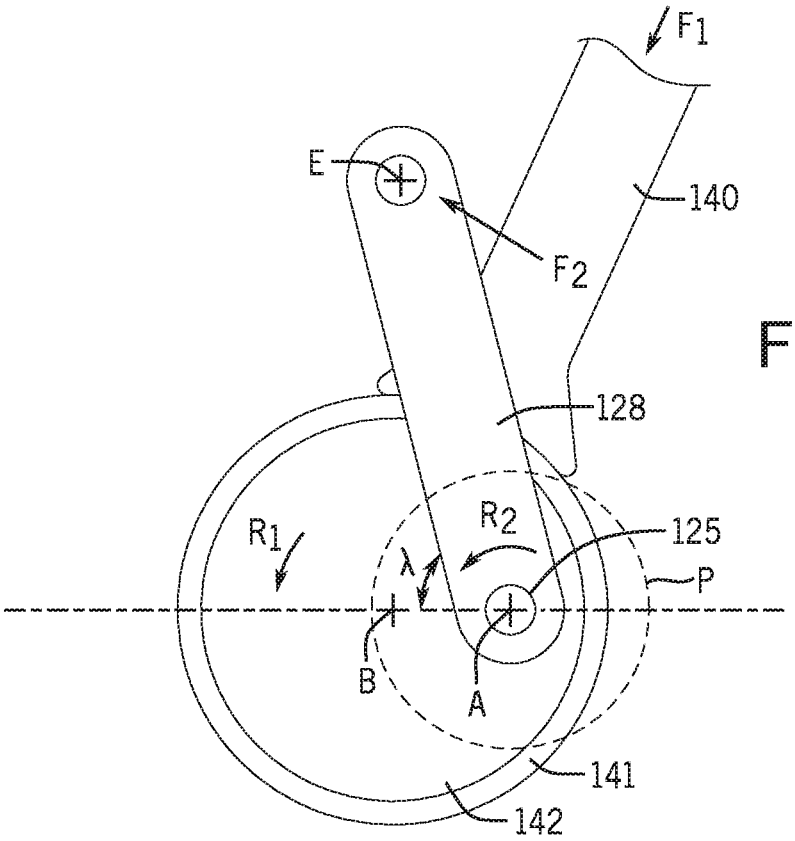
Figure 2G:
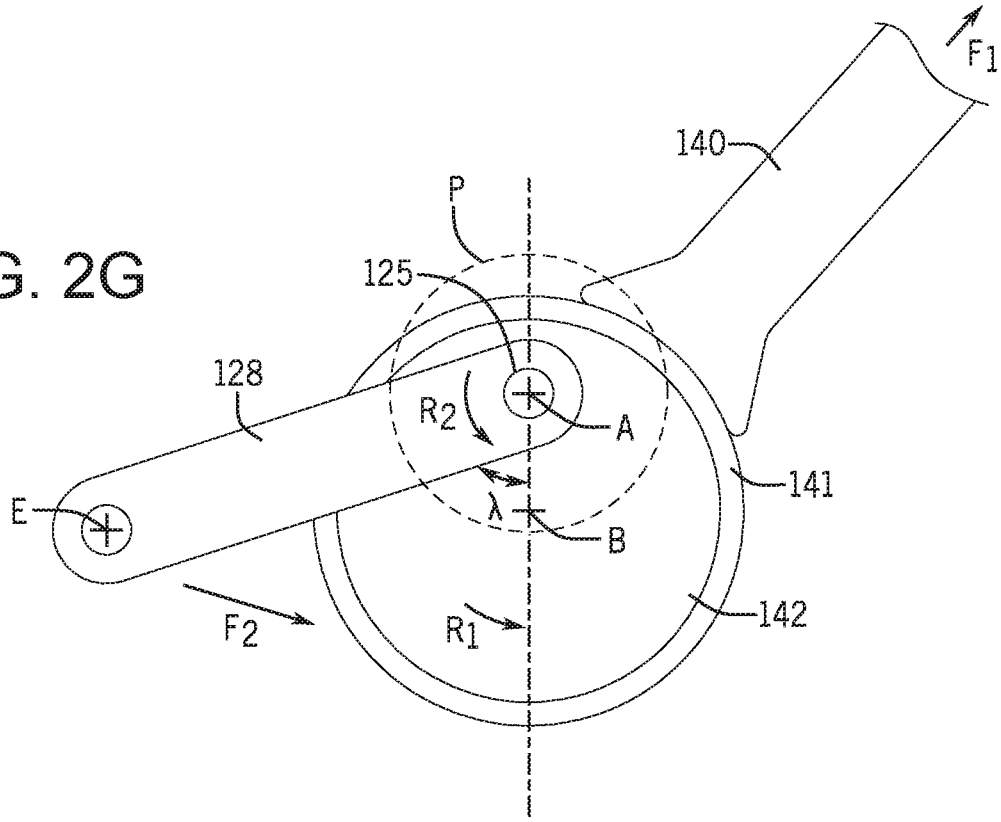

Described herein are embodiments of stationary exercise machines having reciprocating foot and/or hand members, such as foot pedals that move in a closed loop path. The disclosed machines can provide variable resistance against the reciprocal motion of a user, such as to provide for variable-intensity interval training. Some embodiments can comprise reciprocating foot pedals that cause a user's feet to move along a closed loop path that is substantially inclined, such that the foot motion simulates a climbing motion more than a flat walking or running motion. Some embodiments can further comprise reciprocating hand members that are configured to move in coordination with the foot pedals and allow the user to exercise the upper body muscles. Variable resistance can be provided via a rotating air-resistance based fan-like mechanism, via a magnetism based eddy current mechanism, via friction based brakes, and/or via other mechanisms, one or more of which can be rapidly adjustable while the user is using the machine to provide variable intensity interval training.

FIGS. 1-10 show an embodiment of an exercise machine 100. The machine 100 includes a frame 112, which includes a base 114 for contact with a support surface, a vertical brace 116 extending from the base 114 to an upper support structure 120, and first and second inclined members 122 that extend between the base 114 and the vertical brace 116. The various components shown in FIGS. 1-11 are merely illustrative, and other variations, including eliminating components, combining components, rearranging components, and substituting components are all contemplated.

As reflected in the various embodiments described herein, the machine 100 may include an upper moment producing mechanism. The machine may also or alternatively include a lower moment producing mechanism. The upper moment producing mechanism and the lower moment producing mechanism may each provide an input into a crankshaft 125 inducing a tendency for the crankshaft 125 to rotate about axis A. Each mechanism may have a single or multiple separate linkages that produce the moment on the crankshaft 125. For example, the upper moment-producing mechanism may include one or more upper linkages extending from the handles 134 to the crankshaft 125. The lower moment-producing mechanism may include one or more lower linkages extending from the pedal 132 to crankshaft 125. In one example, the machine may include left and right upper linkages, each including a plurality of links configured to connect an input end (e.g., a handle end) of an upper linkage to the crankshaft 125. Likewise, the machine may include left and right lower linkages, each including a plurality of links configured to connect an input end (e.g., a pedal end) of a lower linkage to the crankshaft 125. The crankshaft 125 may have a first side and a second side and may be rotatable about a crankshaft axis A. The first side of the crankshaft may be connected e.g., to the left upper and lower linkages, and the second side of the crankshaft may be connected e.g., to the right upper and lower linkages.

In various embodiments, the lower moment-producing mechanism may include a first lower linkage and a second lower linkage corresponding to a left and right side of machine 100. Each of the first and second lower linkages may include one or more links operatively arranged to transform a force input from the user (e.g., from the lower body of the user) into a moment about the crankshaft 125. For example, the first and second lower linkages may include one or more of first and second pedals 132, first and second rollers 130, first and second lower reciprocating members 126 (also referred to as foot members or foot links 126), and/or first and second crank arms 128, respectively. The first and second lower linkages may operably transmit a force input from the user into a moment about the crankshaft 125.

The machine 100 may include first and/or second crank wheels 124 which may be rotatably supported on opposite sides of the upper support structure 120 about a horizontal rotation axis A. The first and second crank arms 128 are fixed relative to the respective side of the crankshaft 125, which may in turn be fixed relative to the respective first and second crank wheels 124. The crank arms 128 may be positioned on outer sides of the crank wheels 124. The crank arms 128 may be rotatable about the rotation axis A, such that rotation of the crank arms 128 causes the crank wheels 124 and/or the crankshaft 125 to rotate. The first and second crank arms 128 extend from the crankshaft 125 (e.g., from the axis A) in opposite radial directions to their respective radial ends. For example, the first side and the second side of the crank shaft 125 may be fixedly connected to the output ends of the first and second crank arms 128 and the input ends of each crank arm may extend radially from the connection between the crank arm and the crank shaft. First and second lower reciprocating members 126 may have forward ends (i.e., output ends) that are pivotably coupled to the radial ends (i.e., input ends) of the first and second crank arms 128, respectively. The rearward ends (i.e., input ends) of the first and second lower reciprocating members 126 may be coupled to first and second foot pedals 132, respectively. The rearward ends (i.e., input ends) of the first and second lower reciprocating members 126 may thus be interchangeably referred to as pedal ends.

First and second rollers 130 may be coupled to the first and second lower reciprocating members 126, respectively, for example to or proximate the pedal ends or to an intermediate location. In various examples, the first and second rollers 130 may be connected to the pedals, e.g., the first and second pedals 132 may each have first ends with first and second rollers 130, respectively, extending therefrom. Each of the first and second pedals 132 may have second ends with first and second platforms 126*b* (or similarly pads), respectively. First and second brackets 126*a* may form the portion of the first and second pedals 132 which connects the first and second platforms 132*b* and the first and second brackets 132*a*. The first and second lower reciprocating members 126 may be fixedly connected to the first and second brackets 126*a* between the first and second rollers 130, respectively, and the first and second platforms 132*b*, respectively. The connection may be closer to a front of the first and second platform than the first and second rollers 130. The first and second platforms 132*b* may be operable for a user to stand on and provide an input force. The first and second rollers 130 rotate about individual roller axes T. The first and second rollers may rotate on and travel along first and second inclined members 122, respectively. The first and second inclined members 122 may form a travel path along the length and height of the first and second incline members. The rollers 130 can rollingly translate along the inclined members 122 of the frame 112. In alternative embodiments, other bearing mechanisms can be used to provide translational motion of the lower reciprocating members 126 along the inclined members 122 instead of or in addition to the rollers 130, such as sliding friction-type bearings.

When the foot pedals 132 are driven by a user, the pedal ends of the reciprocating members 126 (also referred to as foot members 126) translate in a substantially linear path via the rollers 130 along the inclined members 122. In alternative embodiments, the inclined members can comprise a non-linear portion, such as a curved or bowed portion (e.g., see curved inclined members 123 in FIG. 10), such that pedal ends of the foot members 126 translate in non-linear path via the rollers 130 along the non-linear portion of the inclined members. The non-linear portion of the inclined members can have any curvature, such as a curvature of a constant or non-constant radius, and can present convex, concave, and/or partially linear surfaces for the rollers to travel along. In some embodiments, the non-linear portion of the inclined members 122 can have an average angle of inclination of at least 45°, and/or can have a minimum angle of inclination of at least 45°, relative to a horizontal ground plane.

The output ends of the foot members 126 move in circular paths about the rotation axis A, which drives the crank arms 128 and/or the crank wheels 124 in a rotational motion about axis A. The circular movement of the output ends of the foot members causes the pedal ends to pivot at the roller axis D as the rollers (and thereby roller axis D) translates along the inclined members 122. The combination of the circular motion of the output ends, the linear motion of the pedal ends, and pivotal action about the axis D, causes the pedals 132 to move in non-circular closed loop paths, such as substantially ovular and/or substantially elliptical closed loop paths. The closed loop paths traversed by different points on the foot pedals 132 can have different shapes and sizes, such as with the more rearward portions of the pedals 132 traversing longer distances. A closed loop path traversed by the foot pedals 132 can have a major axis defined by the two points of the path that are furthest apart. The major axis of one or more of the closed loop paths traversed by the pedals 132 can have an angle of inclination closer to vertical than to horizontal, such as at least 45°, at least 50°, at least 55°, at least 60°, at least 65°, at least 70°, at least 75°, at least 80°, and/or at least 85°, relative to a horizontal plane defined by the base 114. To cause such inclination of the closed loop paths of the pedals 132, the inclined members 122 can comprise a substantially linear portion over which the rollers 130 traverse. The inclined members 122 form a large angle of inclination a relative to the horizontal base 114, such as at least 45°, at least 50°, at least 55°, at least 60°, at least 65°, at least 70°, at least 75°, at least 80°, and/or at least 85°. This large angle of inclination which sets the path for the foot pedal motion can provide the user with a lower body exercise more akin to climbing than to walking or running on a level surface. Such a lower body exercise can be similar to that provided by a traditional stair climbing machine.

In various embodiments, the upper moment-producing mechanism 90 may include a first upper linkage and a second upper linkage corresponding to a left and right side of machine 100. Each of the first and second upper linkages may include one or more links operatively arranged to transform a force input from the user (e.g., from the upper body of the user) into a moment about the crankshaft 125. For example the first and second upper linkages may include one or more of first and second handles 134, first and second links 138, first and second upper reciprocating members 140, and/or first and second virtual crank arms 142*a*, respectively. The first and second upper linkages may operably transmit a force input from the user, at the handles 134, into a moment about the crankshaft 125. The first and second handles 134 may be pivotally coupled to the upper support structure 120 at a horizontal axis D.

The handles 134 may be rigidly connected to the input end of respective first and second links 138 such that reciprocating pivotal movement of the handles 134 about the horizontal axis D causes corresponding reciprocating pivotal movement of the first and second links 138 about the horizontal axis D.

For example, the first and second links 138 may be cantilevered off of handles 134 at the pivot aligned with the D axis. Each of the first and second links 138 may have angle ω with the respective handles 134. The angle ω may be measured from a plane passing through the axis D and the curve in the handle proximate the connection to the link 138. The angle ω may be any angle such as angles between 0 and 180 degrees. The angle ω may be optimized to one that is most comfortable to a single user or an average user. The links 138 are pivotably coupled at their radial ends (i.e., output ends) to first and second reciprocating hand members 140. The lower ends of the hand members 140 may include respective circular disks 142 which are rotatable relative to the rest of the hand member 140 about respective disk axes B. The disk axes B, which are located at the center of each disk 142, are parallel to the rotation axis A and offset radially in opposite directions from the axis A. Virtual crank arms 142*a* may thus be defined between the centers of the circular disks 142 (i.e., between axes B) and the rotation axis A.

The lower ends of the upper reciprocating members 140 may be pivotably connected to the first and second virtual crank arms 142*a*, respectively. The first and second virtual crank arms 142*a* may be rotatable relative to the rest of the upper reciprocating members 140 about respective axes B (which may be referred to as virtual crank arm axes). Axes B may be parallel to the crank axis A. Each axis B may be located proximal to an end of each of the upper reciprocating members 140. Each axis B may also be located proximal to one end of the virtual crank arm 142*a*. Each axis B may be offset radially in opposite directions from the axis A. Each respective virtual crank arm 142*a* may be perpendicular to axis A and each of the axes B, respectively. The distance between axis A and each axis B may define approximately the length of the virtual crank arm. This distance between axis A and each axis B is also the length of the moment arm of each virtual crank arm 142*a* which exerts a moment on the crankshaft. As used herein, the virtual crank arm 142*a* may be any device which exerts a moment on the crankshaft 125. For example, as used above the virtual crank arm 142*a* may be the disk 142 (e.g., the distance between the center of the disk 142 and the radial location on disk 142 through which axis A passes. In another example, the virtual crank arm 142*a* may be a crank arm similar to crank arm 128. Each of the virtual crank arms may be a single length of semi-rigid to rigid material having pivots proximal to each end with one of the reciprocating members pivotably connected along axis B proximal to one end and the crankshaft fixedly connected along axis A proximally connected to the other end. The virtual crank arm may include more than two pivots and have any shape. As discussed hereafter, the virtual crank arm is described as being disk 142 but this is merely as an example, as the virtual crank arm may take any form operable to apply a moment to crankshaft 125. For example, the virtual crank arm may be link (e.g., a straight bar member, another type of link or plurality of links operatively coupled to the crankshaft to cause it to rotate). Any embodiment of the present disclosure including the disk may also include the virtual crank arm or any other embodiment of a disk.

The links 138 are pivotably coupled at their radial ends (i.e., output ends) to first and second upper reciprocating members 140. The links 138 and upper reciprocating members 140 are pivotally coupled at respective pivots coaxial with axes C. The lower ends of the upper reciprocating members 140 include respective annular collars 141 and respective circular disks 142, each rotatable within the respective collar. As such, the respective circular disks 142 are rotatable relative to the rest of the upper reciprocating member 140 about respective disk axes B. The disk axes B are parallel to the rotation axis A and offset radially in opposite directions from the axis A.

As the handles 134 articulate back and forth (i.e., reciprocate pivotally about axis D), the links 138 move in corresponding arcs, which in turn articulates the upper reciprocating members 140. Via the fixed connection between the upper reciprocating member 140 and annular collar 141, the articulation of handle 134 also moves annular collar 141. As rotatable disk 142 is fixedly connected to and rotatable around the crankshaft which pivots about axis A, rotatable disk 142 also rotates about axis A. As the upper reciprocating member 140 articulates back and forth it forces the annular collar 141 toward and away from the axis A along a circular path with the result of causing axis B and/or the center of disk 142 to circularly orbit around axis A.

As the crank arms 128 and/or crank wheels 124 rotate about the axis A, the disk axes B orbit about the axis A. The disks 142 are also pivotably coupled to the crank axis A, such that the disks 142 rotate within the respective lower ends of the upper reciprocating members 140 as the disks 142 pivot about the crank axis A on opposite sides of the upper support member 120. The disks 142 can be fixed relative to the respective crank arms 128, such that they rotate in unison around the crank axis A when the pedals 132 and/or the handles 134 are driven by a user.

Figure 10:
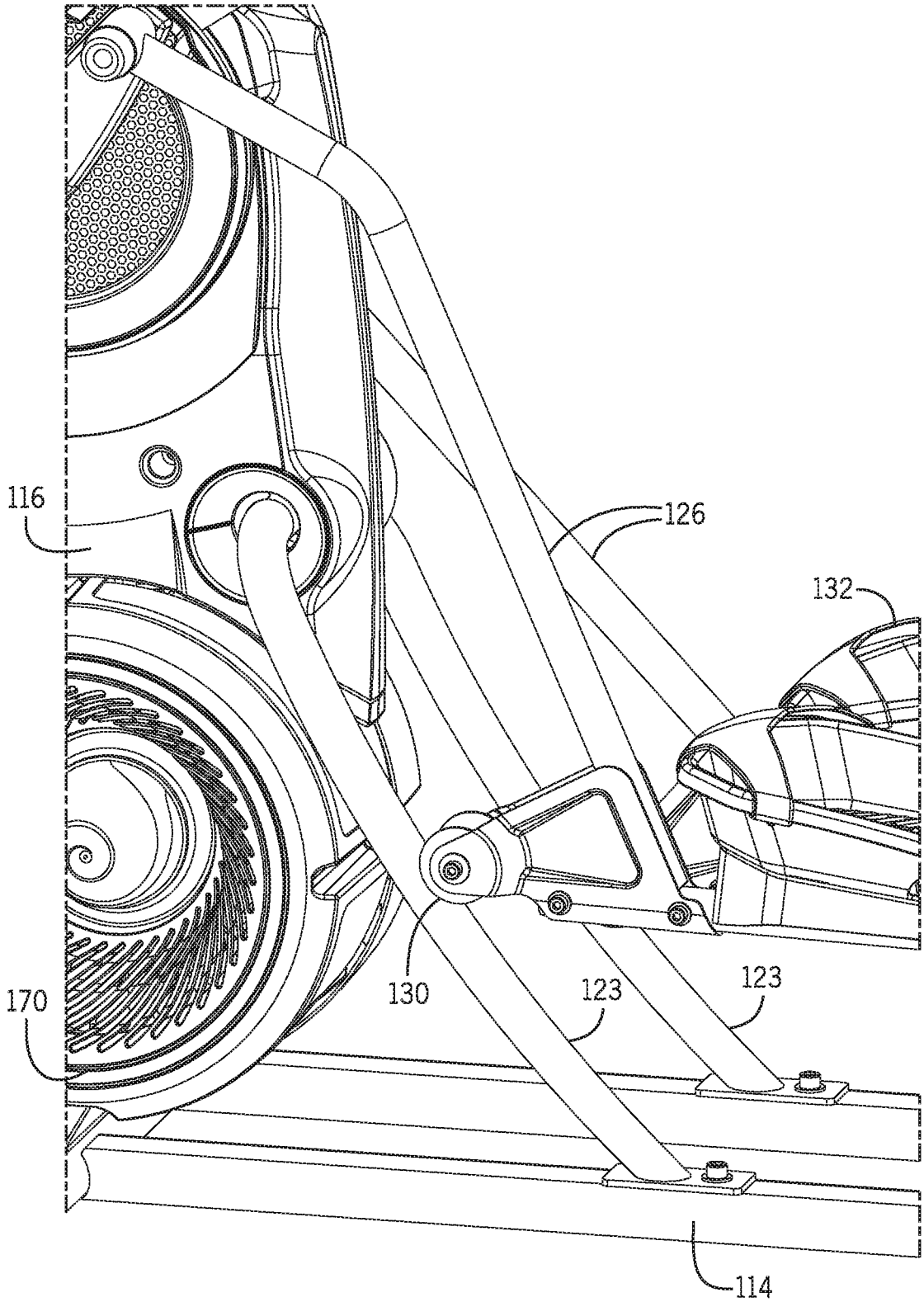
FIG. 10 is a side view of a portion of an exercise machine having curved inclined members.

The upper linkage assemblies may be configured in accordance with the examples herein to cause the handles 134 to reciprocate in opposition to the pedals 132 such as to mimic the kinematics of natural human motion. For example, as the left pedal 132 is moving upward and forward, the left handle 134 pivots rearward, and vice versa. As shown in FIG. 10, the machine 100 can further comprise a user interface 102 mounted near the top of the upper support member 120. The user interface 102 can comprise a display to provide information to the user, and can comprise user inputs to allow the user to enter information and to adjust settings of the machine, such as to adjust the resistance. The machine 100 can further comprise stationary handles 104 mounted near the top of the upper support member 120.

A first or upper linkage 90 of the machine may be configured to produce a first mechanical advantage. Referring now further to FIGS. 9B-9F, the upper linkage 90 may be seen as an eccentric linkage. As illustrated in FIG. 9E, the upper reciprocating member 140 drives the eccentric wheel which includes the annular collar 141 and the disk 142. With the disk rotating around axis A as the fixed pivot, the disk center axis B travels around A in a circular path. This path is possible because of the freedom of relative rotational movement between the annular collar 141 and the disk 142. The distance between axis A and axis B is operable as the rotating arm of the linkage. As shown in the diagram illustrated in FIG. 9E, a force F1 is applied to the upper reciprocating member 140. For example, the force may be in the direction shown or opposite the direction shown. If in the direction shown by F1, the upper reciprocating member 140 and the annular collar 141 place a load on disk 142 through axis B. However, as disk 142 is fixed relative to crankshaft 125, which is rotatable around axis A, the load on disk 142 causes a torque to be placed on the crankshaft 125, which is coaxial with axis A. As the force F1 is sufficient to overcome the resistance in crankshaft 125, the disk 142 begins to rotate in direction R1 and the crankshaft begins to rotate in direction R2. With F1 in the opposite direction, R1 and R2 would likewise be in the opposite direction. As illustrated by FIG. 9F, as the cycle continues for the eccentric linkage, the force F1 must change directions in order to continue driving rotation in the direction R1, R2 of the disk 142 and crankshaft 125 respectively.

In accordance with various embodiments, a second or lower linkage 92 of the machine 100 may be configured to produce a second mechanical advantage. Within the second linkage 92, the pedals 132 pivot around the first and second rollers 30 in response to force being exerted against the first and second lower reciprocating members 126 through the pedals 132. The force on the first and second lower reciprocating members 126 drives the first and second crank arms 128 respectively. The crank arms 128 are pivotably connected at axes E to the first and second lower reciprocating members 126 and fixedly connected to the crankshaft 125 at axis A. As the first and second lower reciprocating members 126 are articulated, the force (e.g. F2 shown in FIGS. 9E, 9F) drives the crank arms 128, which rotate the crankshaft 125 about axis A. FIGS. 9B, 9C, and 9D each show the pedals 132 in different positions with corresponding different positions in the crank arms 128. These corresponding different positions in the crank arms 128 also represent rotation of the crankshaft 125 which is fixedly attached to the crank arms 128. Due to the fixed attachment, the crank arms 128 can transmit input to the crankshaft 125 that the crank arms 128 receive from the first and second lower reciprocating members 126. The crank arms 128 may be fixedly positioned relative to disk 142. As discussed above, the disk 142 may have a virtual crank arm 142*a* which is the portion of the disk 142 extending approximately perpendicular to and between axis B and axis A.

As shown in FIG. 9E, the virtual crank arm 142*a* may be set at an angle of λ from the angle of the crank arm 128 (i.e. the component extending approximately perpendicular to and between axis A and Axis E.) As the disk 142 and the crank arm 128 rotate, for example 90 degrees, the crank arm 128 may stay at the same relative angle to the virtual crank arm 142*a*. The angle λ may be between any angle (i.e. 0-360 degrees). In one example, the angle λ may be between 60° and 90°. In one example, the angle λ may be 75°.

Figure 8:
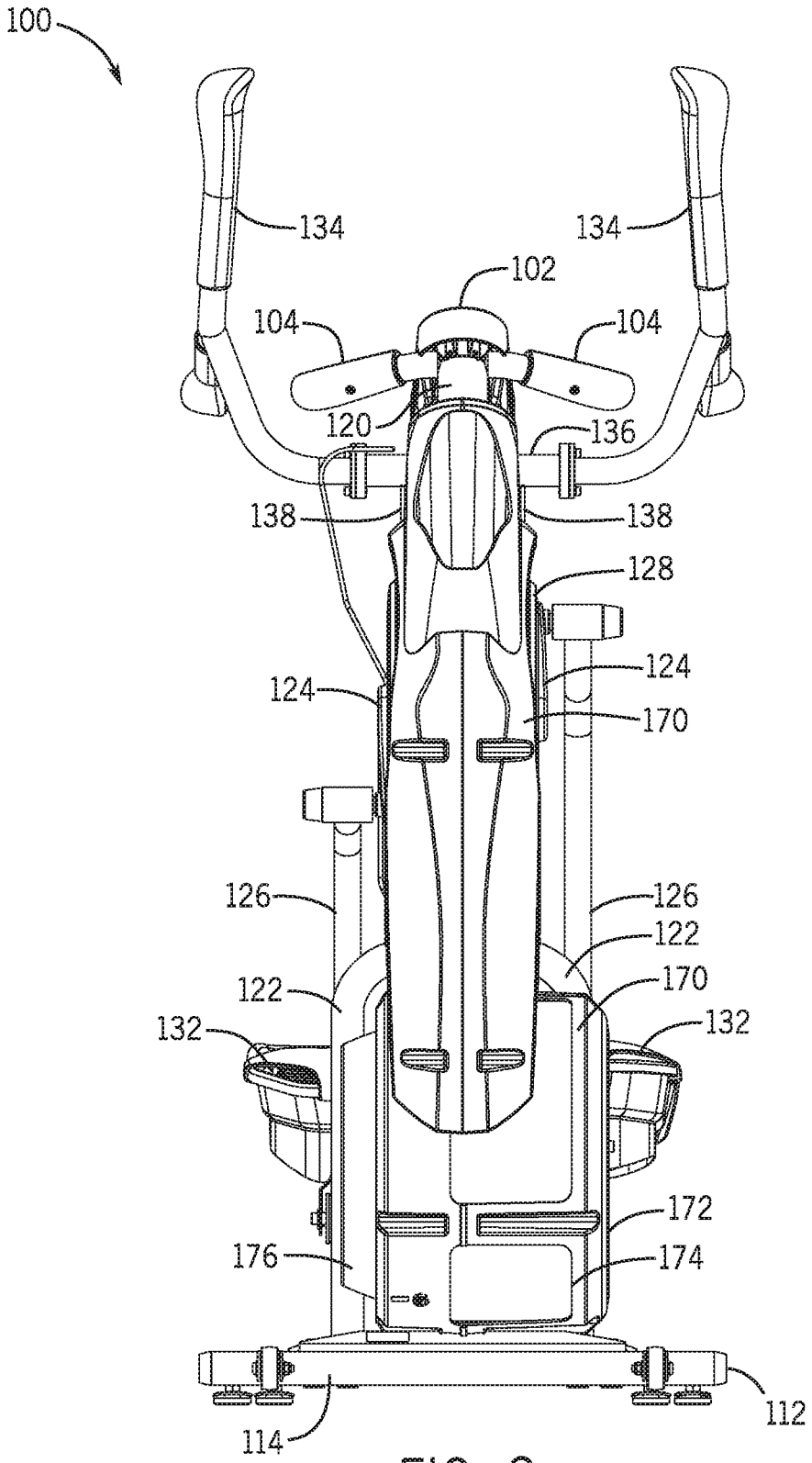
FIG. 8 is a front view of the machine of FIG. 5.
Figure 9:
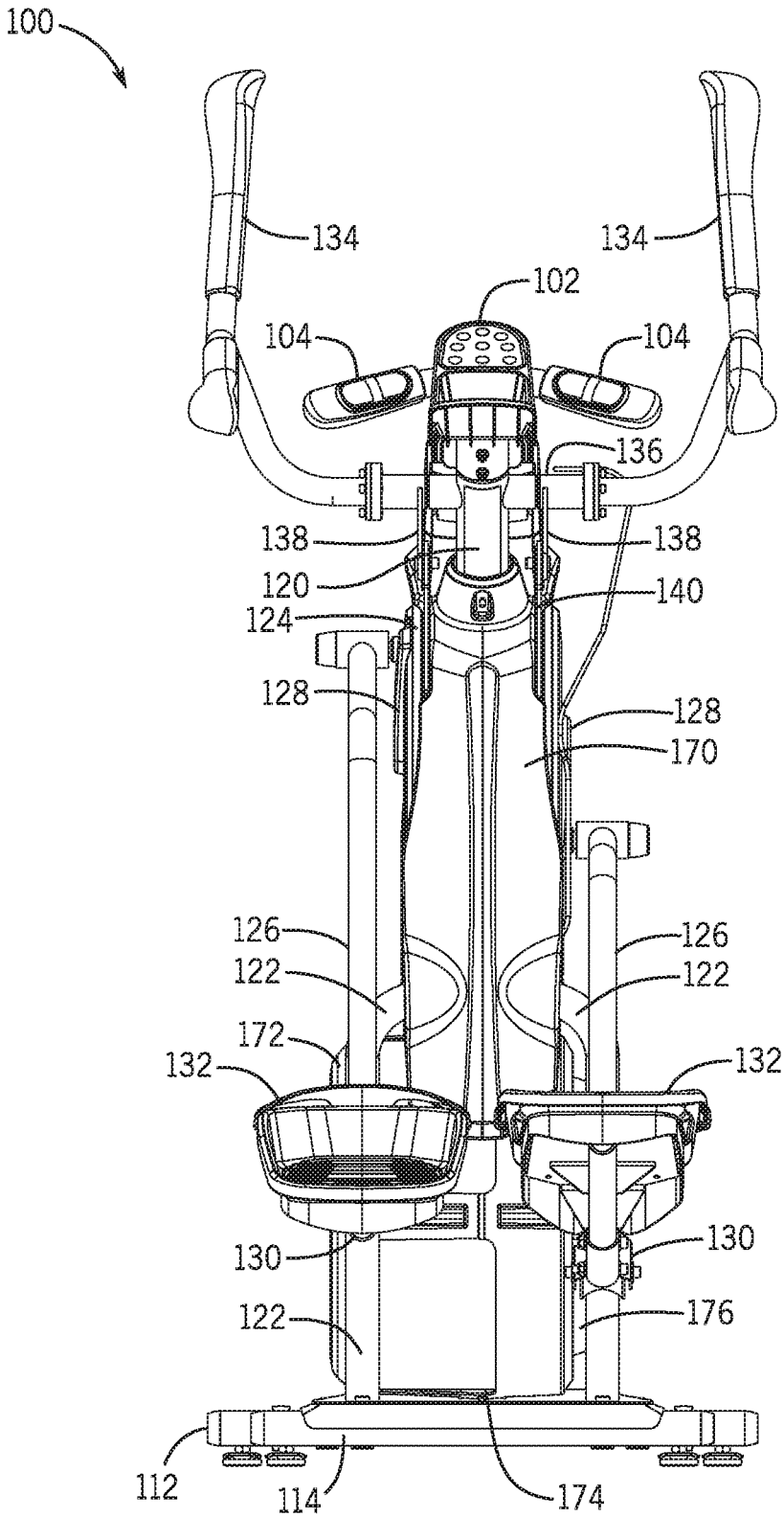
FIG. 9 is a rear view of the machine of FIG. 5.

Understanding this exemplary embodiment of linkages 90 and 92, it may be understood that the mechanical advantage of the linkages may be manipulated by altering the characteristics of the various elements. For example, in first linkage 90, the leverage applied by the handles 134 may be established by length of the handles or the location from which the handles 134 receive the input from the user. The leverage applied by the first and second links 138 may be established by the distance from axis D to axis C. The leverage applied by the eccentric linkage may be established by the distance between axis B and axis A. The upper reciprocating member 140 may connect the first and second links 138 to the eccentric linkage (disk 142 and annular collar 141) over the distance from axis C to axis B. The ratio of the distance between axes D and C compared to the distance between axis B and A (i.e. D-C:B-A) may be in one example, between 1:4 and 4:1. In another example, the ratio may be between 1:1 and 4:1. In another example, the ratio may be between 2:1 and 3:1. In another example, the ratio may be about 2.8:1. In one example, the distance from axis D to axis C may be about 103 mm and the distance from axis B to axis A may be about 35 mm. This defines a ratio of about 2.9:1. Similar ratios may apply to the ratio of axis B to axis A compared to axis A to axis E (i.e. B-A:A-E). In various examples, the distance from axis A to axis E may be about 132 mm. In various examples, the distance from either of axes E to one of the respective axes T (i.e. one of the axes around which the roller rotates) is about 683 mm. The distance from E to T may be represented by X as shown in FIG. 9B. While X generally follows the length of the lower reciprocating member, it may be noted as discussed herein that the lower reciprocating member 126 may not be a straight connecting member but may be multiple portions or multiple members with one or more bends occurring intermediately therein as illustrated in FIG. 8, for example.

With reference to FIGS. 9A-9F, the handles 134 provide an input into the crankshaft 125 through the upper linkage. The pedals 132 provide an input into the crankshaft wheel 125 through a second linkage 92. The crankshaft being fixedly connected to the crank wheel 124 causes the two to rotate together relative to each other.

Each handle may have a linkage assembly, including the handle 134, the pivot axis D, the link 138, the upper reciprocating member 140, and the disk 142. Two handle linkage assemblies may provide input into the crankshaft 125. Each handle linkage may be connected to the crankshaft 125 relative to the pedal linkage assembly such that each of the handles 134 reciprocates in an opposite motion relative to the pedals 132. For example, as the left pedal 132 is moving upward and forward, the left handle 134 pivots rearward, and vice versa.

The upper moment-producing mechanism 90 and the lower moment-producing mechanism 92, functioning together or separately, transmit input by the user at the handles to a rotational movement of the crankshaft 125. In accordance with various embodiments, the upper moment-producing mechanism 90 drives the crankshaft 125 with a first mechanical advantage (e.g. as a comparison of the input force to the moment at the crankshaft). The first mechanical advantage may vary throughout the cycling of the handles 134. For example, as the first and second handles 134 reciprocate back and forth around axis D through the cycle of the machine, the mechanical advantage supplied by the upper moment-producing mechanism 90 to the crankshaft 125 may change with the progression of the cycle of the machine. The upper moment-producing mechanism 90 drives the crankshaft 125 with a second mechanical advantage (e.g. as a comparison of the input force at the pedals to the torque at the crankshaft at a particular instant or angle).

The second mechanical advantage may vary throughout the cycle of the pedals as defined by the vertical position of the rollers 130 relative to their top vertical and bottom vertical position. For example, as the pedals 132 change position, the mechanical advantage supplied by the lower moment-producing mechanism 92 may change with the changing position of the pedals 132. The various mechanical advantage profiles may rise to a maximum mechanical advantage for the respective moment-producing mechanisms at certain points in the cycle and may fall to minimum mechanical advantages at other points in the cycle, In this respect, each of the moment-producing mechanisms 90, 92 may have a mechanical advantage profile that describes the mechanical effect across the entire cycle of the handles or pedals. The first mechanical advantage profile may be different than the second mechanical advantage profile at any instance in the cycle and/or the profiles may generally be different across the entire cycle. The exercise machine 100 may be configured to balance the user's upper body workout (e.g. at the handles) by utilizing the first mechanical advantage differently as compared to the user's lower body workout (e.g. at the pedals 132) utilizing the second mechanical advantage. In various embodiments, the upper moment-producing mechanism 90 may substantially match the lower moment-producing mechanism 92 at such points where the respective mechanical advantage profiles are near their respective maximums. Regardless of difference or similarities in respective mechanical advantage profiles throughout the cycling of the exercise machine, the inputs to the handles and pedals still work in concert through their respective mechanisms to drive the crankshaft 125.

The exercise machine 100 may include a resistance mechanism operatively arranged to resist the rotation of the crankshaft. In some embodiments, the exercise machine may include one or more resistance mechanism such as an air-resistance based resistance mechanism, a magnetism based resistance mechanism, a friction based resistance mechanism, and/or other resistance mechanisms.

Figure 3:
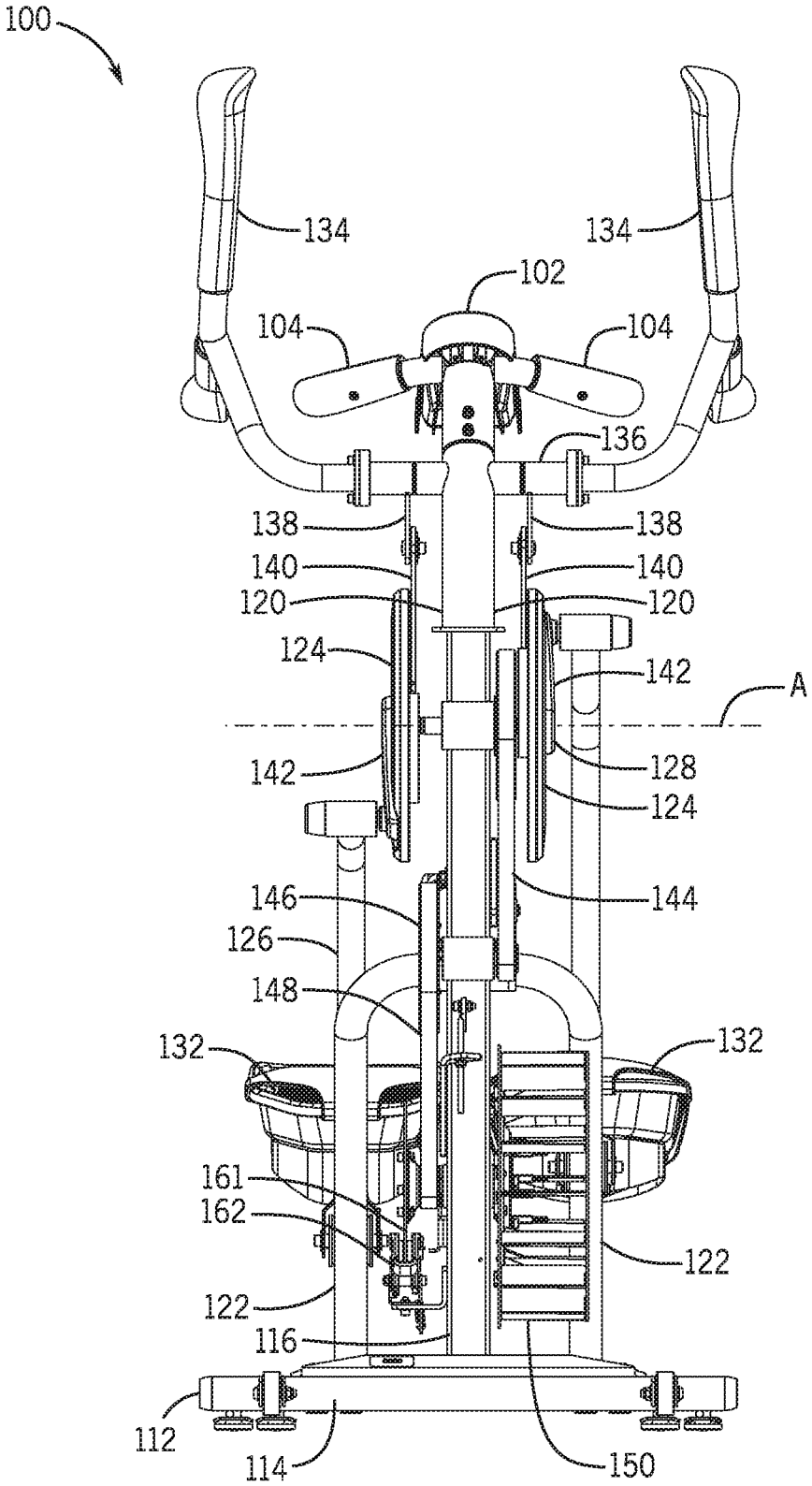
FIG. 3 is a front view of the machine of FIG. 1.

For example, resistance may be applied via an air brake, a friction brake, a magnetic brake or the like. As shown in FIGS. 2 and 3, the machine 100 may include an air-resistance based resistance mechanism, or air brake 150, that is rotationally mounted to the frame 112 on a horizontal shaft 166. The machine 100 may additionally or alternatively include a magnetic-resistance based resistance mechanism, or magnetic brake 160 (see e.g., FIGS. 1 and 4), which includes a rotor 161 rotationally mounted to the frame 112 and a brake caliper 162 also mounted to the frame 112. The rotor 161 and the air brake 150 may be coupled to the same horizontal shaft (e.g., shaft 166). The air brake 150 and rotor 161 are driven by the rotation of the crankshaft 125 and are each operable to resist the rotation of the crankshaft 125. In the illustrated embodiment, the shaft 166 is driven by a belt or chain 148 that is coupled to a pulley 146. Pulley 146 is coupled to another pulley 124 mounted coaxially with the axis A by another belt or chain 144. The pulleys 124 and 146 can be used as a gearing mechanism to set the ratio of the angular velocity of the air brake 150 and the rotor 161 relative to the reciprocation frequency of the pedals 132.

One or more of the resistance mechanisms can be adjustable to provide different levels of resistance at a given reciprocation frequency. Further, one or more of the resistance mechanisms can provide a variable resistance that corresponds to the reciprocation frequency of the exercise machine, such that resistance increases as reciprocation frequency increases. For example, one reciprocation of the pedals 132 can cause several rotations of the air brake 150 and rotor 161 to increase the resistance provided by the air brake 150 and/or the magnetic brake 160. The air brake 150 can be adjustable to control the volume of air flow that is induced to flow through the air brake at a given angular velocity in order to vary the resistance provided by the air brake.

Figure 4:
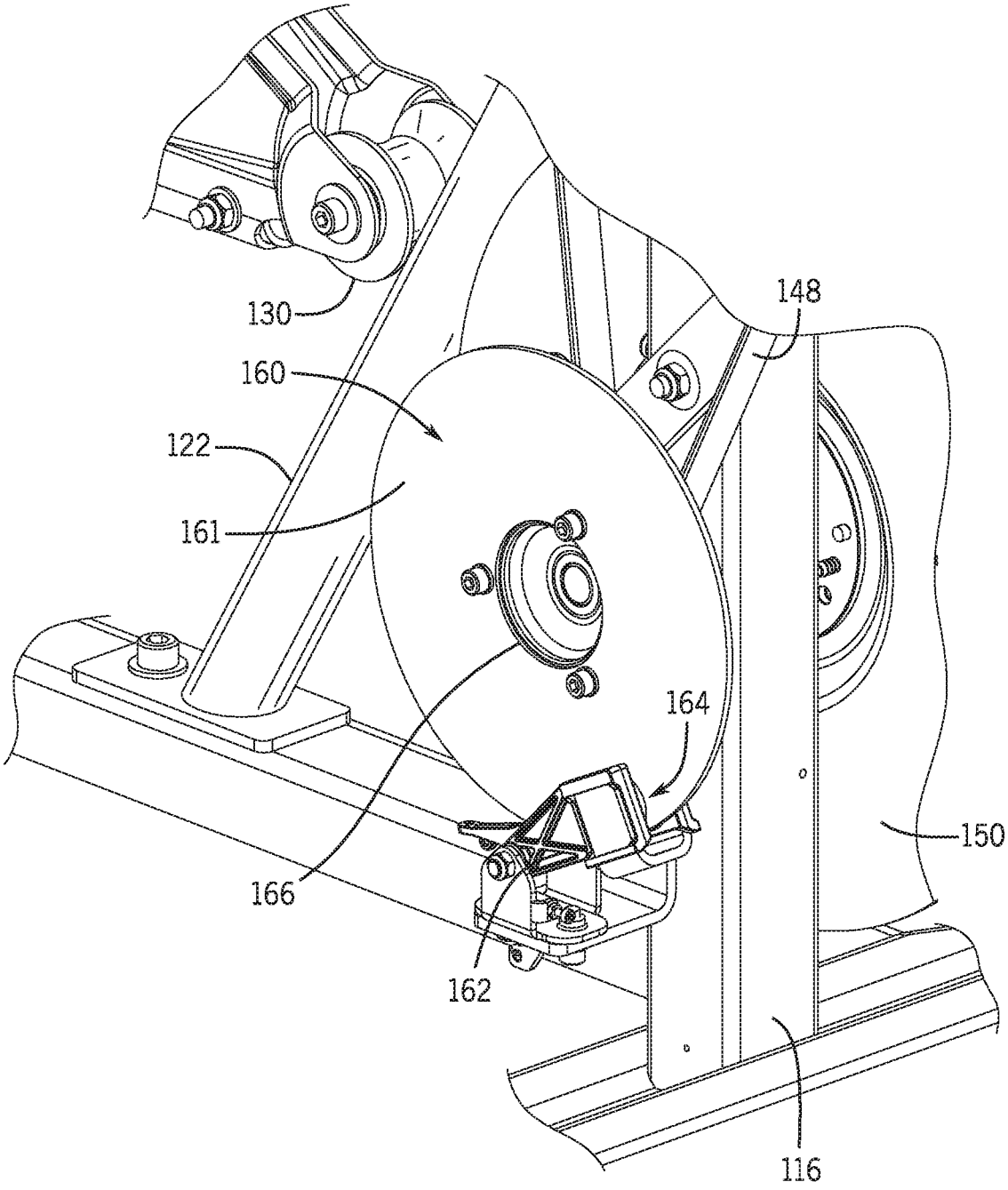
FIG. 4 is a perspective view of a magnetic brake of the machine of FIG. 1.
Figure 5:
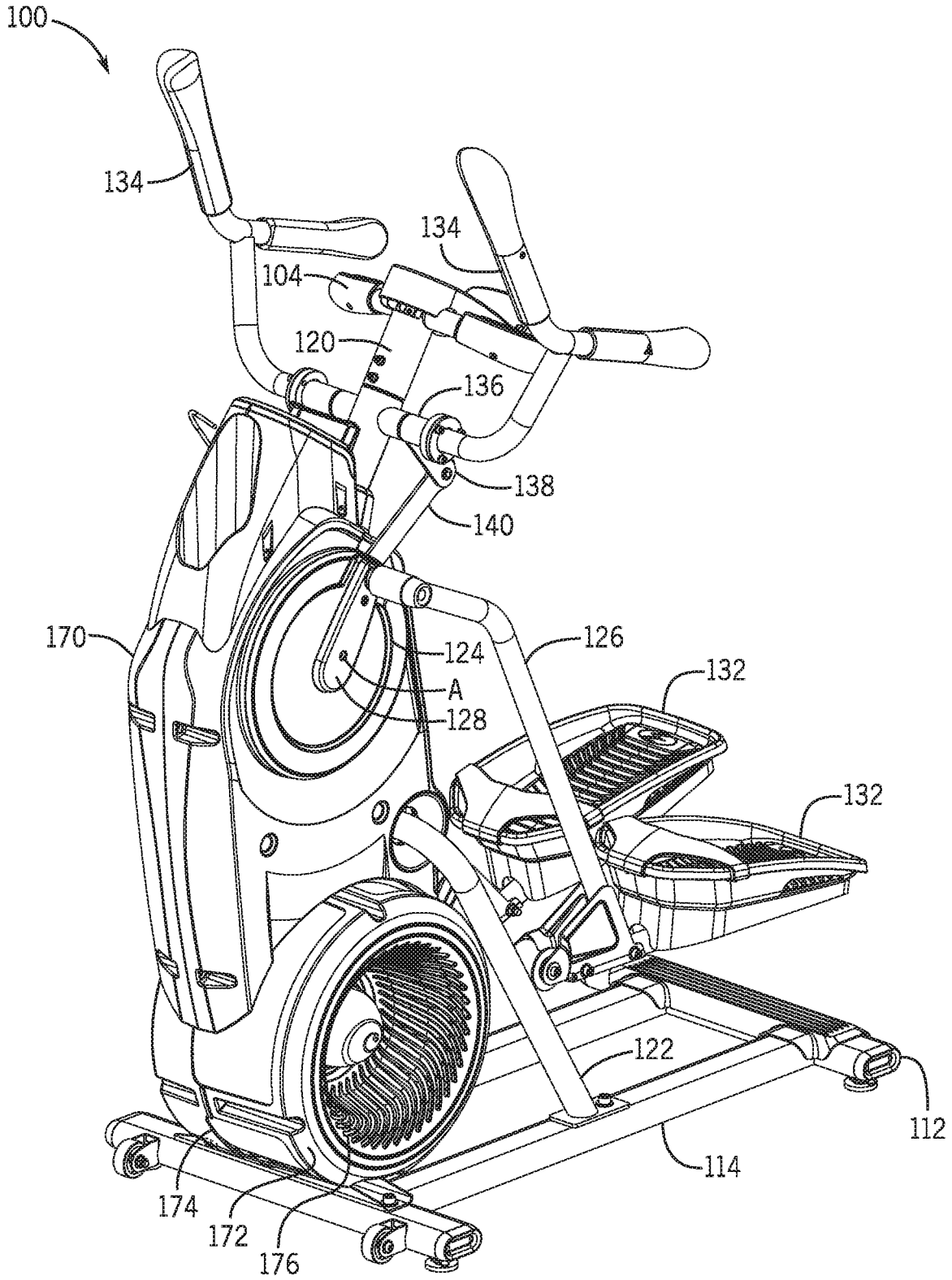
FIG. 5 is a perspective view of an embodiment of the machine of FIG. 1 with an outer housing included.
Figure 6:
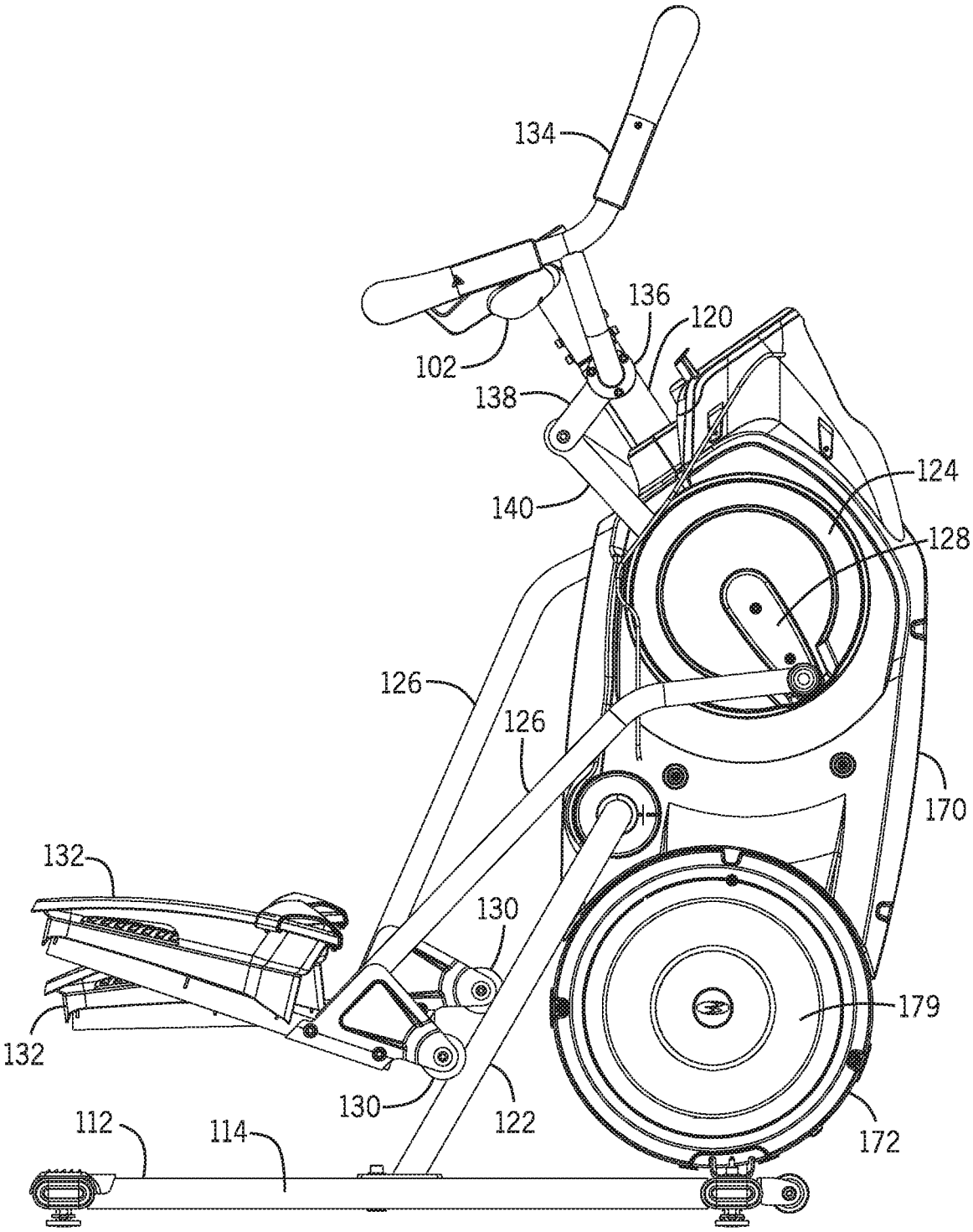
FIG. 6 is a right side view of the machine of FIG. 5.
Figure 7:
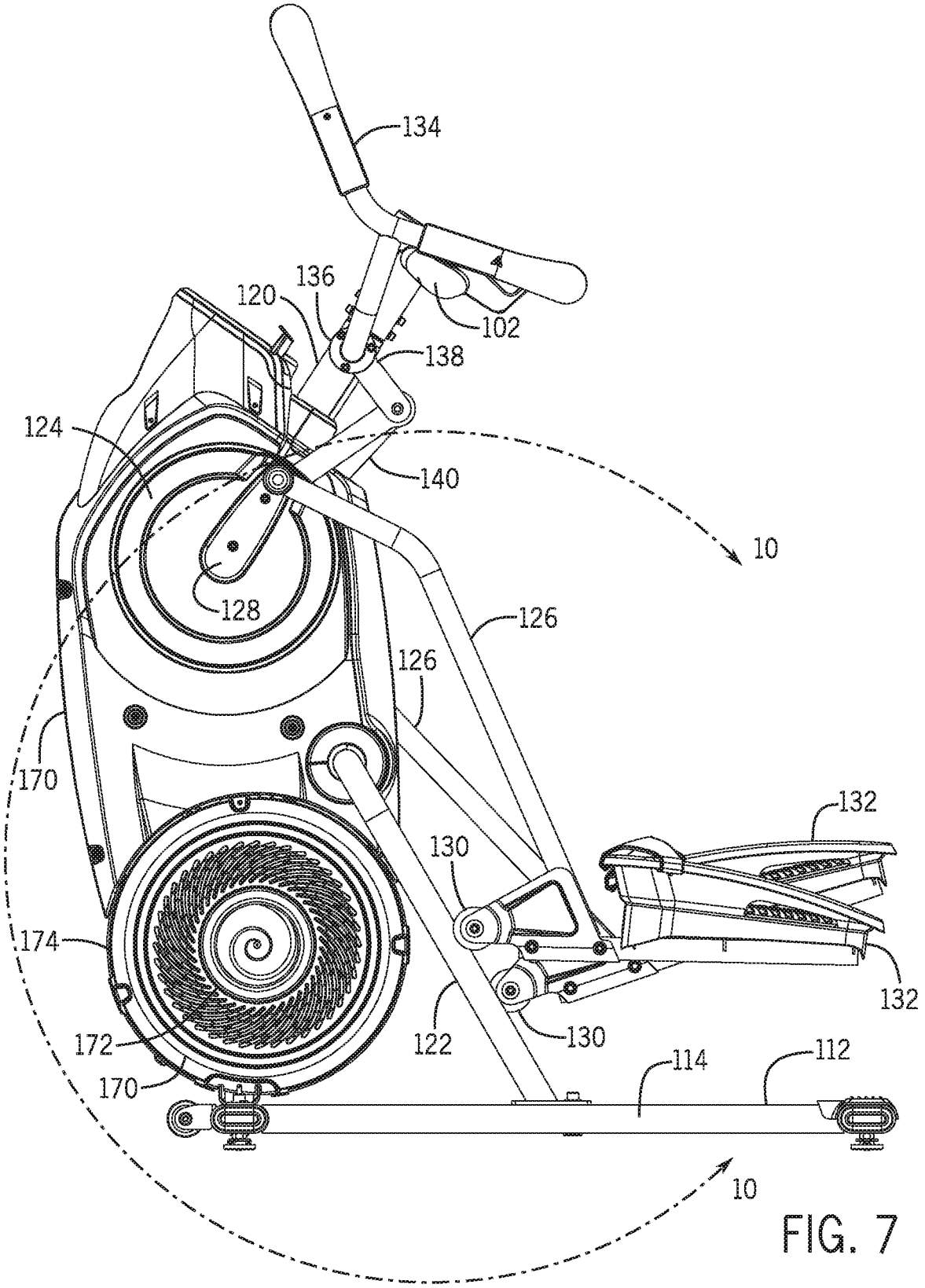
FIG. 7 is a left side view of the machine of FIG. 5.

The magnetic brake 160 provides resistance by magnetically inducing eddy currents in the rotor 161 as the rotor rotates. As shown in FIG. 4, the brake caliper 162 includes high power magnets 164 positioned on opposite sides of the rotor 161. As the rotor 161 rotates between the magnets 164, the magnetic fields created by the magnets induce eddy currents in the rotor, producing resistance to the rotation of the rotor. The magnitude of the resistance to rotation of the rotor can increase as a function of the angular velocity of the rotor, such that higher resistance is provided at high reciprocation frequencies of the pedals 132 and handles 134. The magnitude of resistance provided by the magnetic brake 160 can also be a function of the radial distance from the magnets 164 to the rotation axis of the shaft 166. As this radius increases, the linear velocity of the portion of the rotor 161 passing between the magnets 164 increases at any given angular velocity of the rotor, as the linear velocity at a point on the rotor is a product of the angular velocity of the rotor and the radius of that point from the rotation axis. In some embodiments, the brake caliper 162 can be pivotably mounted, or otherwise adjustable mounted, to the frame 116 such that the radial position of the magnets 164 relative to the axis of the shaft 166 can be adjusted. For example, the machine 100 can include a motor coupled to the brake caliper 162 that is configured to move the magnets 164 to different radial positions relative to the rotor 161. As the magnets 164 are adjusted radially inwardly, the linear velocity of the portion of the rotor 161 passing between the magnets decreases, at a given angular velocity of the rotor, thereby decreasing the resistance provided by the magnetic brake 160 at a given reciprocation frequency of the pedals 132 and handles 134. Conversely, as the magnets 164 are adjusted radially outwardly, the linear velocity of the portion of the rotor 161 passing between the magnets increases, at a given angular velocity of the rotor, thereby increasing the resistance provided by the magnetic brake 160 at a given reciprocation frequency of the pedals 132 and handles 134.

In some embodiments, the brake caliper 162 can be adjusted rapidly while the machine 10 is being used for exercise to adjust the resistance. For example, the radial position of the magnets 164 of the brake caliper 162 relative to the rotor 161 can be rapidly adjusted by the user while the user is driving the reciprocation of the pedals 132 and/or handles 134, such as by manipulating a manual lever, a button, or other mechanism positioned within reach of the user's hands (see e.g., FIG. 3) while the user is driving the pedals 132 with his feet. Such an adjustment mechanism can be mechanically and/or electrically coupled to the magnetic brake 160 to cause an adjustment of eddy currents in the rotor and thus adjust the magnetic resistance level. The user interface 102 can include a display to provide information to the user, and can include user inputs to allow the user to enter to adjust settings of the machine, such as to adjust the resistance. In some embodiments, such a user-caused adjustment can be automated, such as using a button on the user interface 102 that is electrically coupled to a controller and an electrical motor coupled to the brake caliper 162. In other embodiments, such an adjustment mechanism can be entirely manually operated, or a combination of manual and automated. In some embodiments, a user can cause a desired magnetic resistance adjustment to be fully enacted in a relatively short time frame, such as within a half-second, within one second, within two seconds, within three second, within four seconds, and/or within five seconds from the time of manual input by the user via an electronic input device or manual actuation of a mechanical device. In other embodiments, the magnetic resistance adjustment time periods can be smaller or greater than the exemplary time periods provided above.

FIGS. 5-9 show an embodiment of the exercise machine 100 with an outer housing 170 mounted around a front portion of the machine. The housing 170 can house and protect portions of the frame 112, the pulleys 125 and 146, the belts or chains 144 and 148, lower portions of the upper reciprocating members 140, the air brake 150, the magnetic brake 160, motors for adjusting the air brake and/or magnetic brake, wiring, and/or other components of the machine 100. The housing 170 can include an air brake enclosure 172 that includes lateral inlet openings 176 to allow air into the air brake 150 and radial outlet openings 174 to allow air out of the air brake. The housing 170 can further include a magnetic brake enclosure 179 to protect the magnetic brake 160, where the magnetic brake is included in addition to or instead of the air brake 150. The crank arms 128 and/or crank wheels 124 can be exposed through the housing such that the lower reciprocating members 126 can drive them in a circular motion about the axis A without obstruction by the housing 170.

Figure 11A:
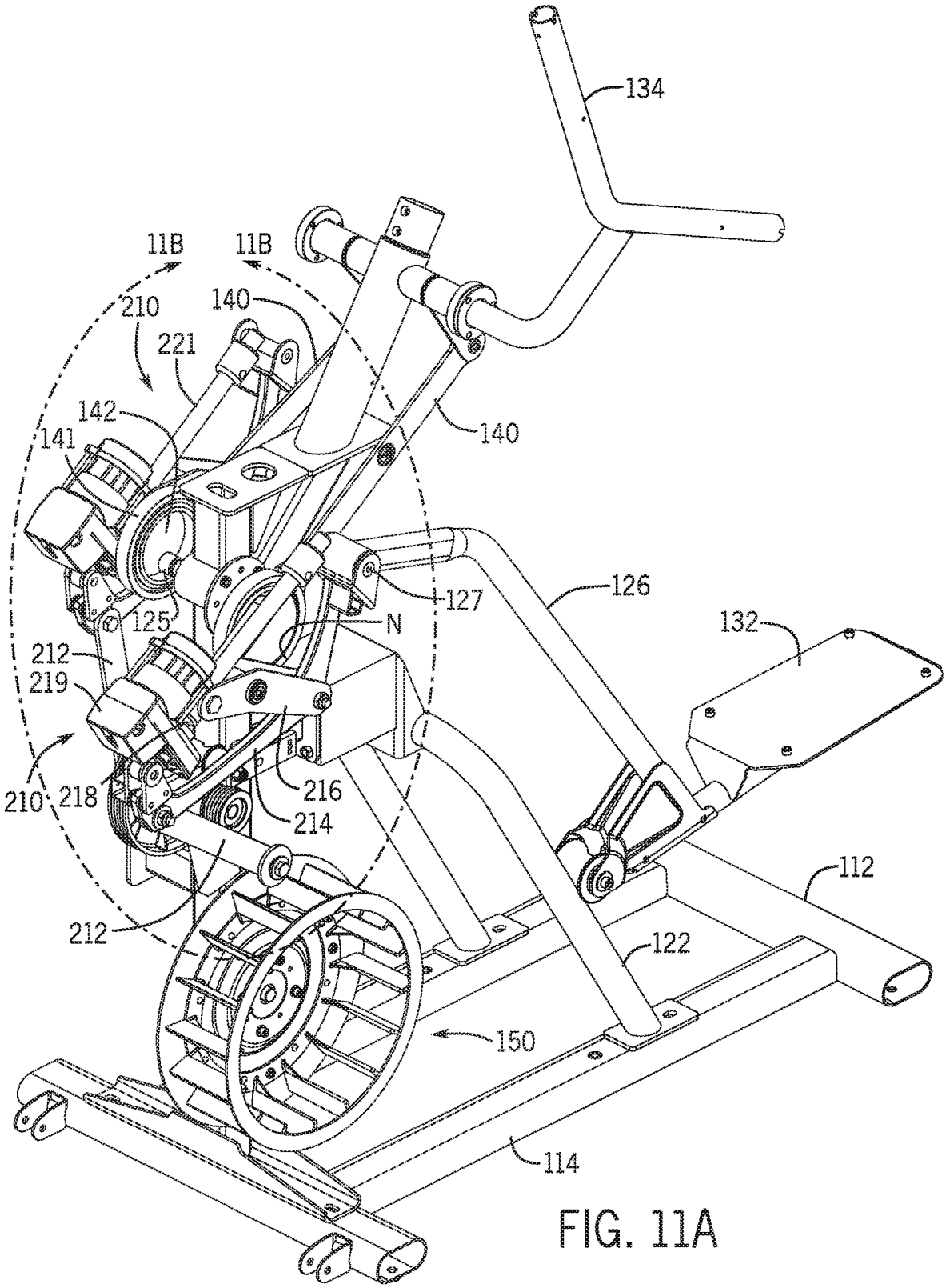
FIGS. 11A and 11B are partial perspective views of an exercise machine with adjustable lower linkages.
Figure 11B:
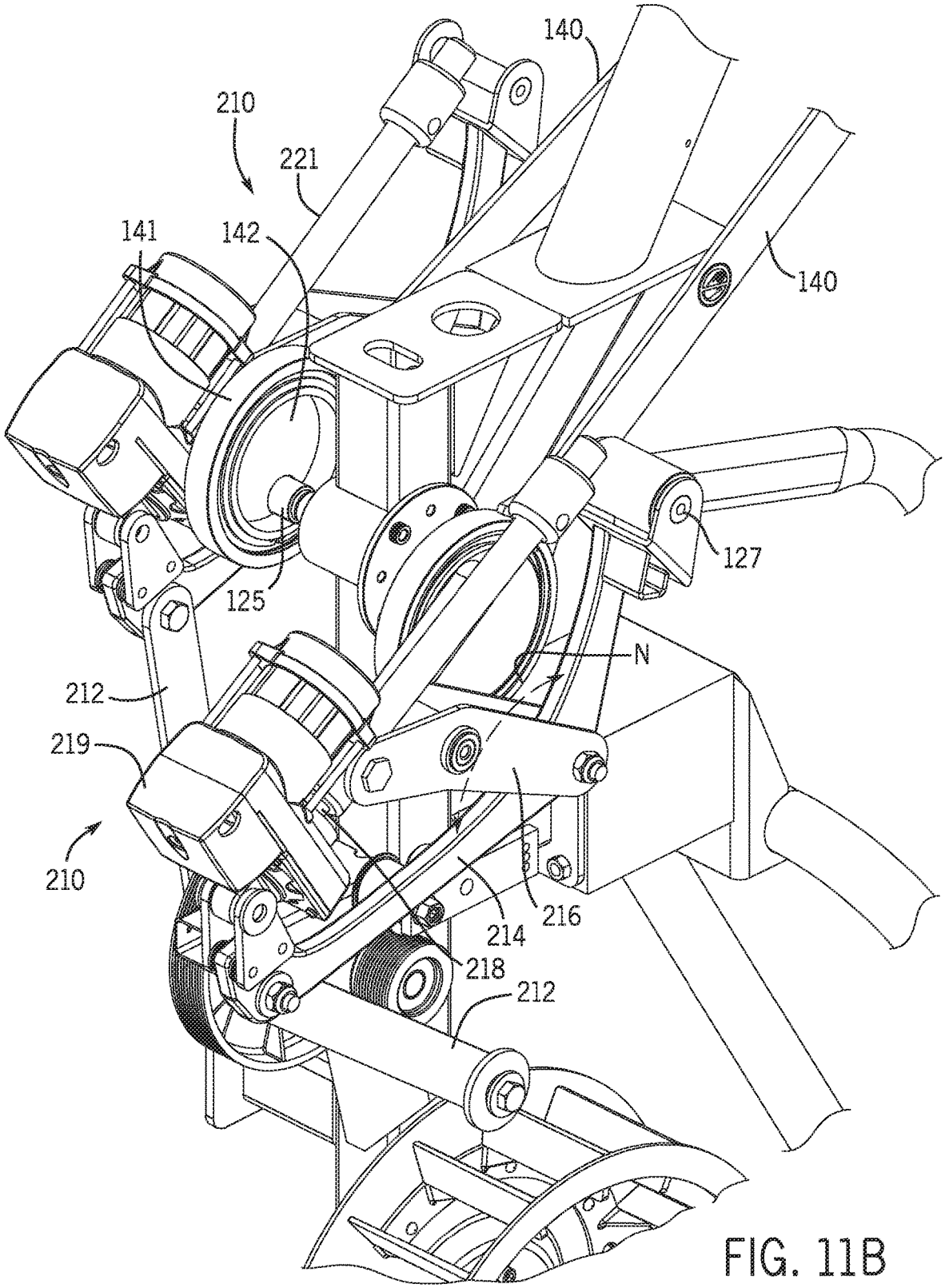

FIGS. 11A-15D show views of an exercise machine 200. FIGS. 11A and 11B show partial perspective views of the exercise machine 200 and FIGS. 12-15D show partial left side views of the exercise machine 200. Some of the components of the machine 200 are omitted from these views for clarity of illustration. For example, only those linkages associated with the left side are shown in the views in FIGS. 12-15D; however, it will be understood that the machine 200 includes the same arrangement of linkages associated with the other side (in this case, right side) of the machine, which as noted, have been omitted from these figures for clarity.

The exercise machine 200 may include one or more of the components of the machine 100. Same or similar components are designated using the same reference numbers. For example, the exercise machine 200 may include first and second (e.g., left and right) upper linkages 90 which may include the same or substantially the same components as the upper linkages of the exercise machine 100. The exercise machine 200 may differ from the machine 100 in that the exercise machine 200 includes adjustable lower linkages for varying the stride provided by the exercise machine 200. Like machine 100, each of the first and second (e.g., left and right) lower linkages 192 of the exercise machine 200 may include a reciprocating member 126 operatively connecting a pedal 132 to a crank arm 128.

In the machine 200, each of the lower linkages 192 may include an adjustable linkage 210. Each of the first and second adjustable linkages 210 may be connected between the reciprocating member and the crank arm and operable to vary a distance between the output end of the reciprocating member and an input end of the crank arm. An adjustable linkage 210 according to the present disclosure may be operable to vary a distance between an output end of the reciprocating member and an input end of the crank arm. In some examples, the adjustable linkage 210 may include at least three links pivotally coupled to one another and a variable length member coupled to at least two of the links to vary a distance between the at least two links. In some embodiments, the adjustable linkage 210 includes a first link 212 pivotally connected to the frame of the machine 200, a second link 214 pivotally connected to the first link 212 and to the reciprocating foot member 126, a third link 216 pivotally connected to the second link 214 and the crank arm 128, and a variable length member 218 connected to the second link 214 and the third link 216. The adjustable linkage 210 may be configured for varying the distance between at least one portion of the second link (e.g., an attachment point of the second link) and a portion of the third link (e.g., an attachment point of the third link). The second and third links may be pivotally coupled to one another. The adjustable linkage 210 may thus be configured to vary the angle between the second and third links.

In accordance with some examples herein, the adjustable linkage 210 may be operatively coupled between the reciprocating member 126, the crank arm 128, and/or the frame to allow the length of the stride provided by a lower linkage 192 to be varied. As previously described, each reciprocating member 126 may have a forward end (i.e., output end 127) that is operatively coupled to the radial end (i.e., input end 129) of a crank arm 128. In the embodiment of machine 200, the output end 127 of the reciprocating member 126 is operatively coupled to the crank arm 128 via the adjustable linkage 210. The rearward end (i.e., input or pedal end) of the lower reciprocating member 126 may be coupled to a pedal 132. When the foot pedal 132 is driven by a user, the pedal end of the reciprocating member 126 translates or reciprocates along the inclined member 122. The pedal end may translate along a substantially linear or a non-linear path. The output end of the reciprocating member 126 traverses a generally circular or generally elliptical path (e.g., as shown by 201-1, 201-2 in FIGS. 12 and 13, respectively) to drive the crank arm 128 and/or the crank wheel 124 in a rotational motion about axis A. The combination of the rotating motion of the output ends 127 and translating or reciprocating motion of the pedal ends causes the pedals 132 to move in non-circular closed loop paths, such as substantially ovular and/or substantially elliptical closed loop paths.

Figure 12:
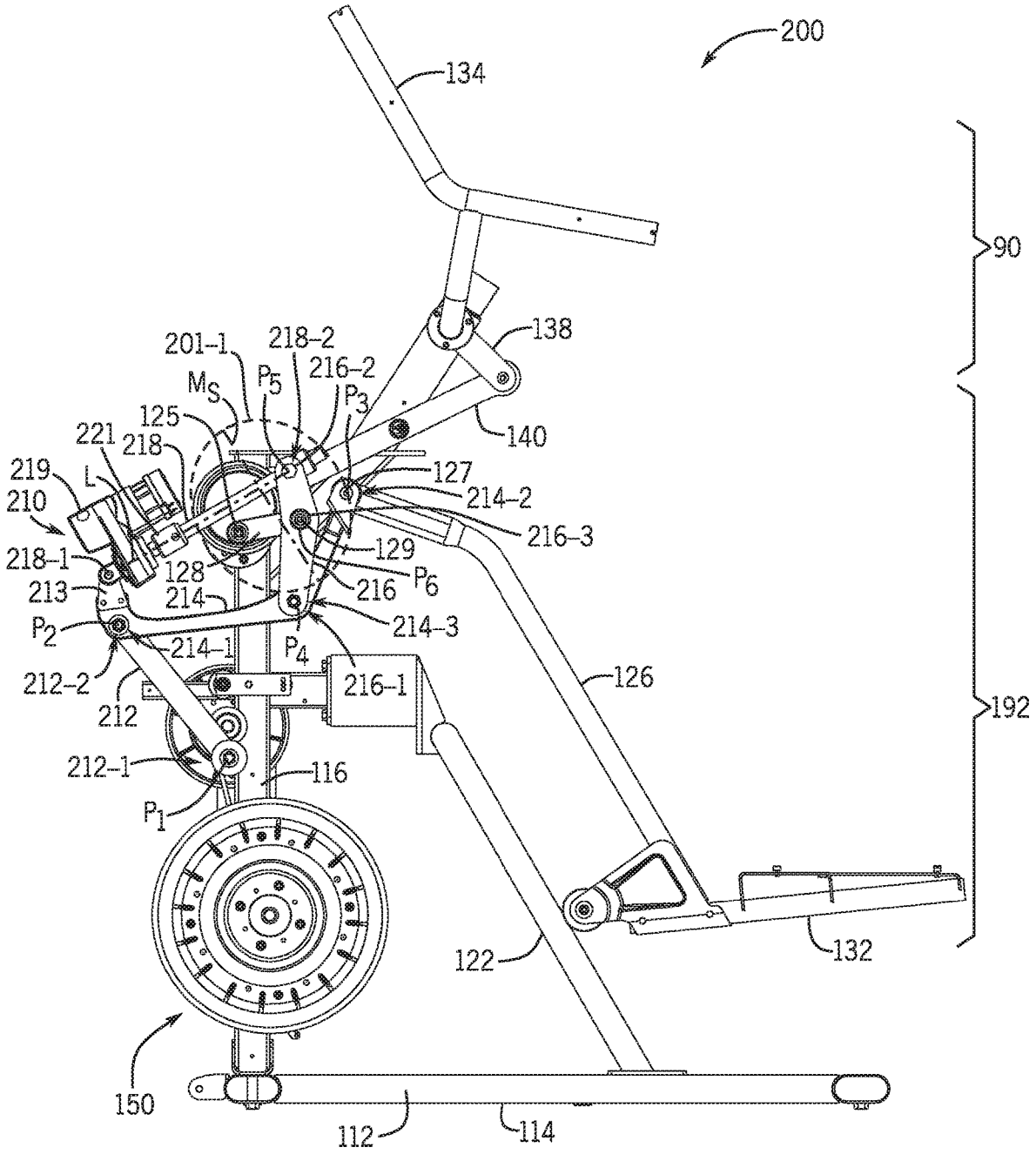
FIG. 12 is a side view of the machine of FIG. 11A with an adjustable linkage provided in a first configuration.

Each of the left and right adjustable linkages 210 may be variably adjustable between a narrow configuration or setting (see e.g., FIGS. 12 and 14A-14D) and a wide configuration or setting (see e.g., FIGS. 13 and 15A-15D) and any intermediate setting therebetween. In some examples, when the adjustable linkage 210 is in a narrow configuration, the corresponding lower linkage 192 is configured to a short stride setting, thus providing a relatively shorter range of travel of the pedal end of the reciprocating member 126. Conversely, when the adjustable linkage 210 is in a wide configuration, the corresponding lower linkage 192 is configured to a long stride setting, thus providing a relatively longer range of travel of the pedal end of the reciprocating member 126. Length of stride as used to describe a lower linkage 192 and/or reciprocating member 126 generally refers to the amount of travel of the reciprocating pedal end and/or the rotating output end of the reciprocating member 126. Referring to the stride or a stride setting as short or shorter implies that the amount of travel is shorter than that of a stride or stride setting described as long or longer. For example, a short or shorter stride may imply that the pedal end of the reciprocating member 126 travels a relatively shorter amount or distance (e.g., along the incline member 122) as compared to a stride described as long or longer. Additionally or alternatively, a short or shorter stride may imply that the output end 127 of the reciprocating member 126 travels a relatively shorter amount or distance (e.g., as may be defined by the diameter of a circular path or the major axis of an elliptical path traversed by the output end 127) as compared to a stride described as long or longer. For example, the output end 127 of the reciprocating member 126 in FIG. 12 is configured to traverse a generally elliptical path 201-1 having a relatively shorter major axis $M_s$. as compared to the major axis ML of the generally elliptical path 201-2 traversed by the end 127 of the reciprocating member 126 in FIG. 13. The generally elliptical path 201-2 traversed by the output end 127 in the long stride setting may be more eccentric than the generally elliptical path 201-1 traversed by the output end 127 in the short stride configuration, thus the major axis ML may be longer than the major axis $M_s$. Regardless of the shape of the path, the output end 127 may be configurable (e.g., by an adjustment of the adjustable linkage 210 and thus an adjustment to the stride setting) to traverse a distance in the vertical direction which is greater when the lower linkage is in the long stride setting rather as compared to the distance in the vertical direction when the lower linkage is in the short stride setting. That is, the output end 127 of the reciprocating member 126 may be configured to traverse a first distance in the vertical direction when the lower linkage 192 is in the first stride configuration (e.g., short stride setting) and a second distance in the vertical direction which is greater than the first distance when the lower linkage 192 is in the second stride configuration (e.g., long stride setting). Each of the adjustable linkages 210 may be variably adjustable to any intermediate position or setting between the narrow configuration and the wide configuration thereby enabling the respective lower linkage 192 to be configurable to any intermediate stride setting between the shortest and longest stride settings, e.g., for accommodating a variety of users and/or a variety of strides when exercising at different speeds.

Figure 13:
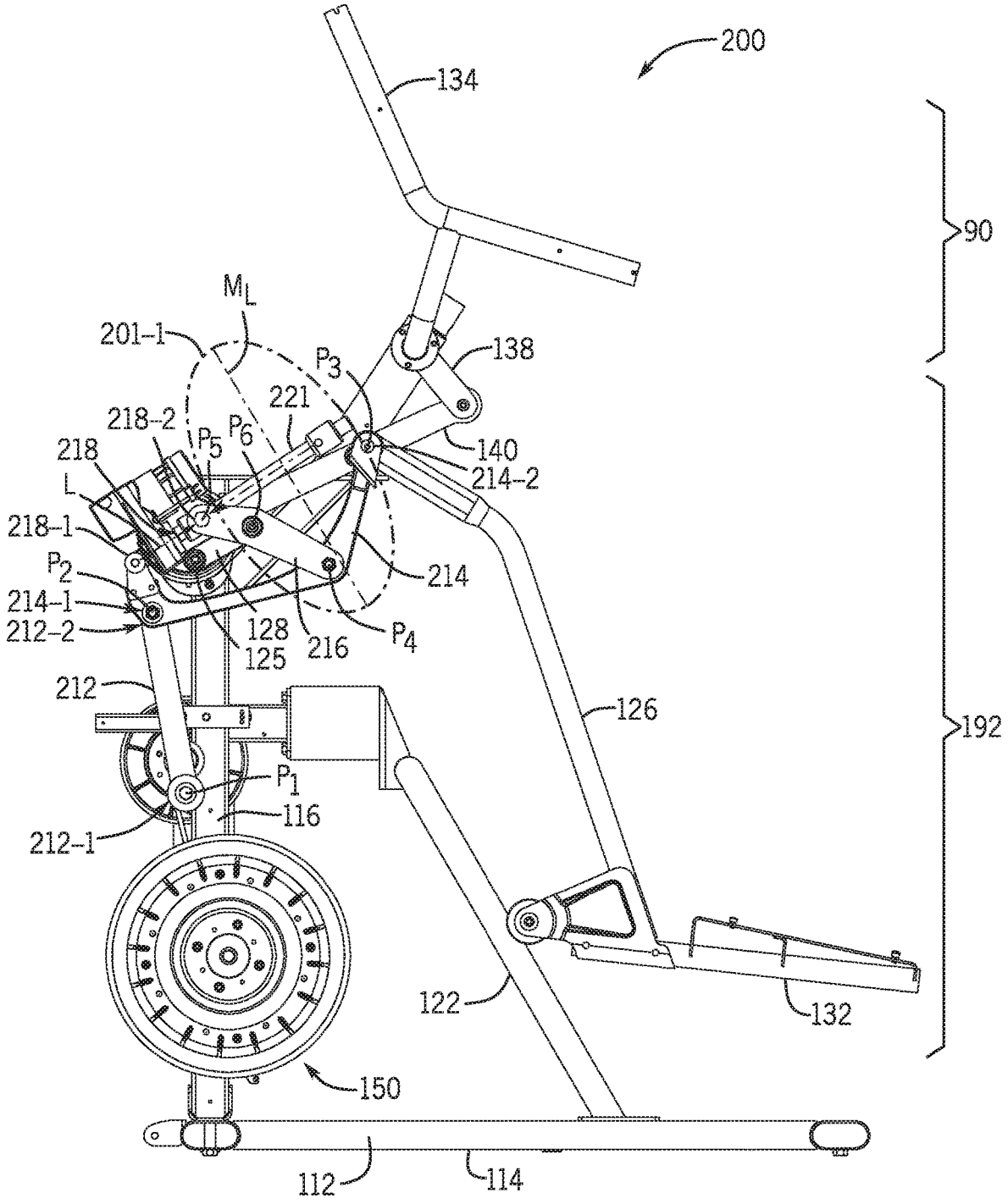
FIG. 13 is a side view of the machine of FIG. 11A with an adjustable linkage provided in a second configuration.

The adjustable linkage 210 may include a plurality of links, including at least one variable length member, operatively connected to vary the distance between an input end and an output end of the adjustable linkage. The input end of the adjustable linkage 210 may be connected to the output end 127 of the reciprocating member 126 and the output end of the adjustable linkage 210 may be connected to the input end 129 of the crank arm 128. The stride length of provided by a lower linkage 192 may thus be adjustable by varying the distance between the input and output ends of the adjustable linkage 210. In some embodiments, the distance between the input and output ends of the adjustable linkage 210 may be varying by positioning a variable length member therebetween. In some embodiments, the variable length member may be positioned elsewhere, e.g., between attachment points of the adjustable linkage 210 other than the input and output ends of the adjustable linkage 210 and in which embodiments, a change in the distance between the end points of the variable length member indirectly causes a change in the distance between the input and output ends of the adjustable linkage 210. For example, FIGS. 12 and 13 illustrate one embodiment of an adjustable linkage 210 which includes a variable length member connected to vary the distance between attachment points other than the input and output ends of the adjustable linkage 210. In some embodiments, the variably length member may additionally or alternatively be operably connected to vary an angle between two or more links of the adjustable linkage 210. For example, the variable length member may be operatively arranged with respect to other links of the adjustable linkage (210) to vary an angle between the second link (214) and the third link (216).

An adjustable linkage 210 according to one embodiment may include an anchor link 212, a coupler link 214, an output link 216, and a variable length member 218. The anchor link 212 may be a substantially straight bar member, which includes two attachment points at opposite ends 212-1 and 212-2 of the anchor link 212. The first end 212-1 the anchor link 212 may be pivotally connected to the frame 112 (e.g., to vertical brace 116) at a first pivot attachments or pivot joint $P_1$. The second end 212-2 of the anchor link 212 may be pivotally connected to the coupler link 214 at a second pivot attachments or pivot joint $P_2$. The pivot joints may be implemented using simple pin joints, bearings, or the like.

The coupler link 214 may include two generally straight bar portions 215-1 and 215-2 angled to one another (e.g., defining an angle N therebetween) and joined at an intermediate portion 215-3. The first and second portions 215-1 and 215-2 are rigidly joined (e.g., integrally formed) such that the angle N remains fixed. In some embodiments, the angle W may be greater than 90 degrees, for example between 110 and 130 degrees, or between 105 and 145 degrees. The coupler link 214 may include three attachment points, including a first attachment point at one end 214-1 of the coupler link, a second attachment point at the opposite end 214-2 of the coupler link, and a third attachment point 214-3, which may be located between, but not necessarily in the middle of, the first and second ends 214-1 and 214-2, respectively. The third attachment point 214-3 may be located at the intermediate portion 215-3. The first end 214-1 of the coupler link 214 is pivotally joined to the anchor link 212 at the pivot joint $P_2$. The second end 214-2 of the coupler link 214 is pivotally joined to the output end 127 of the reciprocating member 126 at pivot joint $P_3$. Thus, the second end 214-2 of the coupler link 214 may be considered the input end of the adjustable linkage 210. The third attachment point 214-3 of the coupler link 214 is pivotally joined to the output link 216 at pivot joint $P_4$. In other words, the coupler link 214 is pivotally jointed to the output link at an intermediate location between its first and second ends 214-1 and 214-2, respectively. A tab 213 may be rigidly coupled to (e.g., mechanically fastened or integrally formed) and extend from the coupler link 214 proximate the pivot joint $P_2$. The tab 213 may provide a supporting structure for connecting one end 218-1 of the variable length member 218. The opposite end 218-2 of the variable length member 218 may be connected to the output link 216.

The output link 216 connects the adjustable linkage 210 to the crank arm 128. The output link 216 may include three attachment points, including first attachment point at one end 216-1 of the output link, second attachment point at the opposite end 216-2 of the output link 216, and a third attachment point 216-3 at an intermediate location between, but not necessarily in the middle of, the first and second ends 216-1 and 216-2, respectively. Each of the attachment points may pivotally couple the output link 216 to other structure of the machine 200.

The first end 216-1 may be pivotally joined to the coupler link 214 at the pivot joint $P_4$. The second end 216-2 may be pivotally joined to second end 218-2 of the variable length member 218 at pivot joint $P_5$. The third attachment point 216-3 may pivotally join the output link 216 to the crank arm 128 at pivot joint $P_6$. Thus, the third attachment point 216-3 of the output link 214 may be considered the output end of the adjustable linkage 210.

The variable length member 218 may be operatively connected between the coupler link 214 and output link 216 to vary the distance between the input and output ends of the adjustable linkage 210. The variable length member 218 may include a first attachment point 218-1 located at one end of the variable length member 218, and a second attachment point 218-2 provided on a movable portion of the variable length member 218. The movable portion may be movable between a retracted position and extended position to thereby change the distance between the first and second attachment points 218-1 and 218-2. In accordance with the examples herein, the first and second attachment points 218-1 need not coincide with the input and output ends of the adjustable linkage 210 to effect a change in the distance between the input and output ends of the adjustable linkage by adjustment of the distance between the first and second attachment points 218-1.

The variable length member 218 may be implemented using a linear actuator 221, such as a screw actuator, a hydraulic cylinder, or the like. The variable length member 218 (e.g., linear actuator) may be electronically, electro-hydraulically, hydraulically, or manually operated. The variable length member 218 may be operatively associated with a power source 219 (e.g., a motor, a pump, etc.). For example, a linear actuator 221 may include a screw actuator and a motor operatively associated with the screw actuator to drive the moving portion (e.g., the nut) along the shaft portion (e.g., the screw). The first attachment point may be a point located at a stationary portion of the linear actuator and the second attachment point may be located on a moving portion of the linear actuator, such that extension and retraction of the linear actuator effects a change in the distance between the first and second attachment points.

A number of the point joints described above as pivotally coupled are pivotable at some but not all times of use of the machine. For example, certain ones of the pivotally coupled links may pivot in relation to one another during adjustment of the stride length but may be locked into place (pivotally restrained) at other times, such as when the stride setting is not being adjusted. That is, the variable length member 218 may be operable to vary the distance between certain of the attachment points which may cause one or more of the pivot joints (e.g., $P_4$ and $P_5$) to pivot during the adjustment. When the adjustment is completed (i.e., when the distance L has been set) certain of the pivot joints (e.g., $P_4$ and $P_5$) may become pivotally restrained until another adjustment of the length is performed. Certain ones of the pivot joints (e.g., $P_1$, $P_2$, $P_3$, and $P_6$) may be free to pivot at all times, e.g., responsive to movement of the pedals by a user, to enable the transfer of rotational movement of the output end 127 of the reciprocating member 126 to a rotational movement of the input end 129 of the crank arm 128. When the user drives pedals 132, the pivot joints $P_1$, $P_2$, $P_3$, and $P_6$ may pivot about their respective pivot axes to transfer the movement of the pedals 132 to the crank arm 128 and thus the crank shaft 125.

FIGS. 14 and 15 show side views of the machine 200 at different points along the pedal stroke. In FIGS. 14A-14D, the machine 200 is configured in a short stride setting and in FIGS. 15A-15D, the machine 200 is configured in a long stride setting. In each of the views in FIGS. 14A-14D and 15A-15D, the relative position of the links of the adjustable linkage is shown at four points of the pedal stroke (e.g., bottom, first middle, top, and opposite middle positions along the path traversed by the output end 127 of the reciprocating member 126). In a single pedal stroke, the input end of the reciprocating member 126 may traverse the same linear path twice (e.g., starting from a lowest vertical position to a highest vertical position and returning to the lowest vertical position, while the output end 127 of the reciprocating member 126 completes a single revolution or rotation along the generally elliptical path (e.g., path 201-1 or 201-2).

Figure 14A:
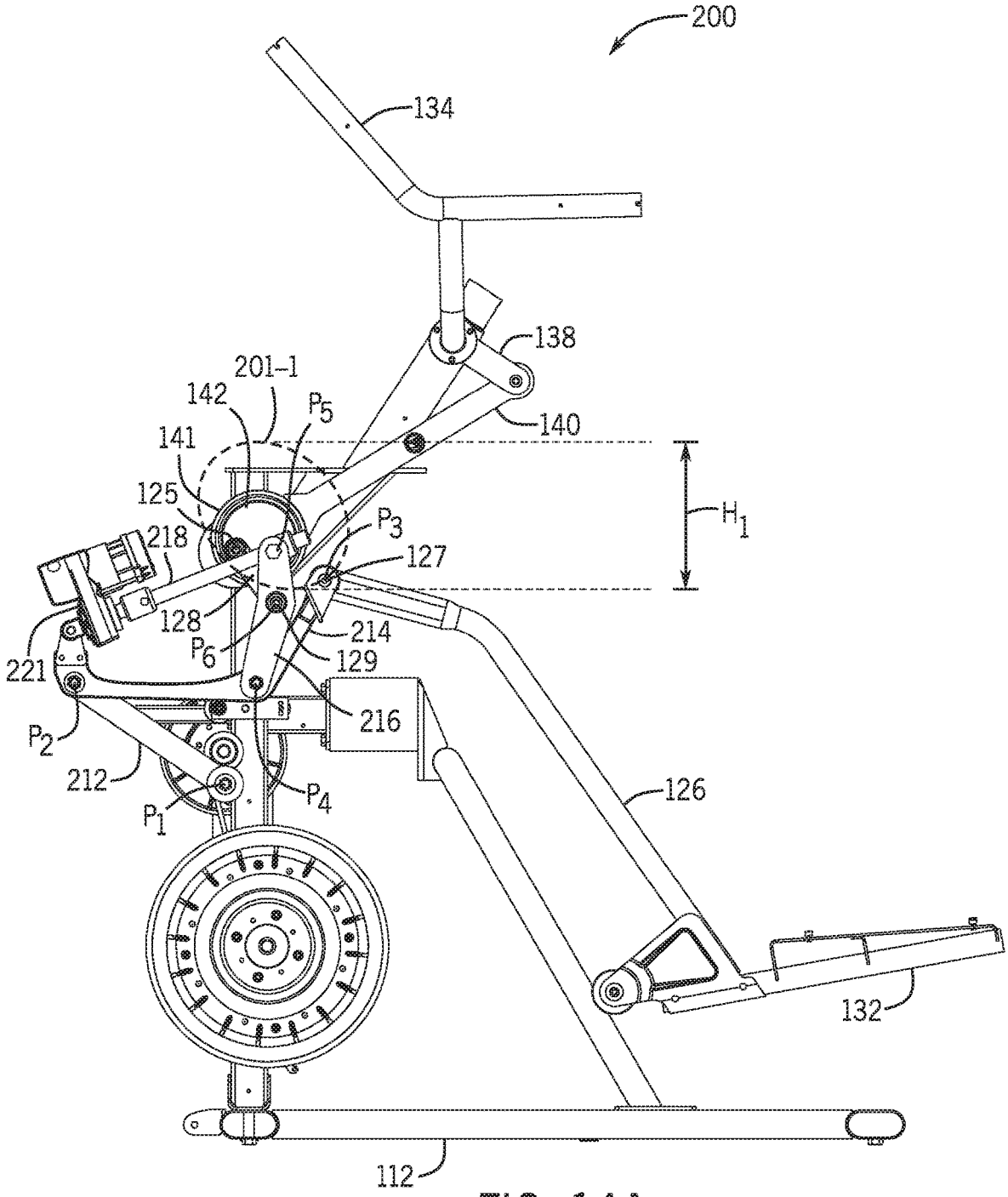
FIGS. 14A-14D are side views of the machine in FIG. 12 illustrating positions of the linkages during a pedal stroke.
Figure 14B:
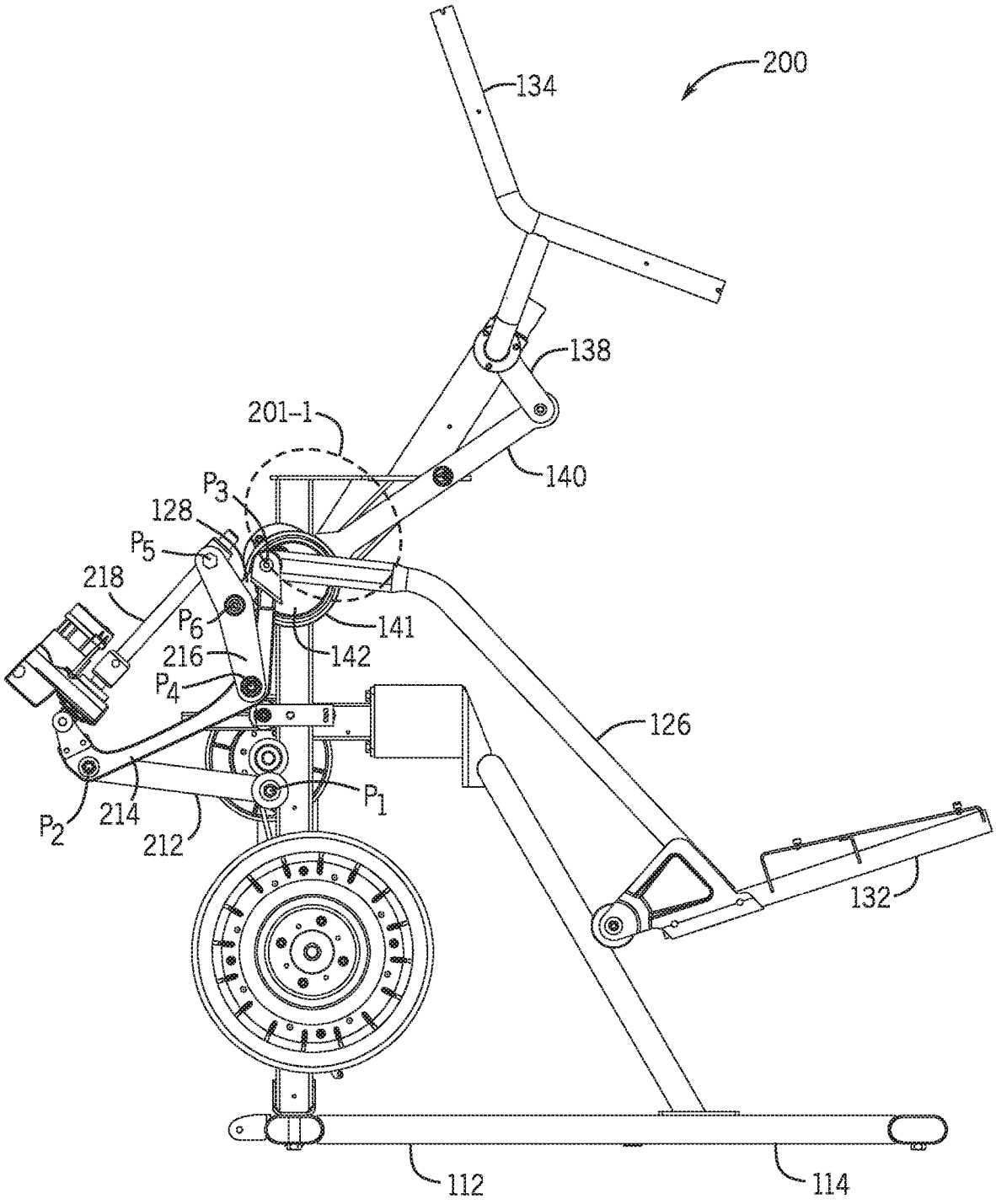
Figure 14C:
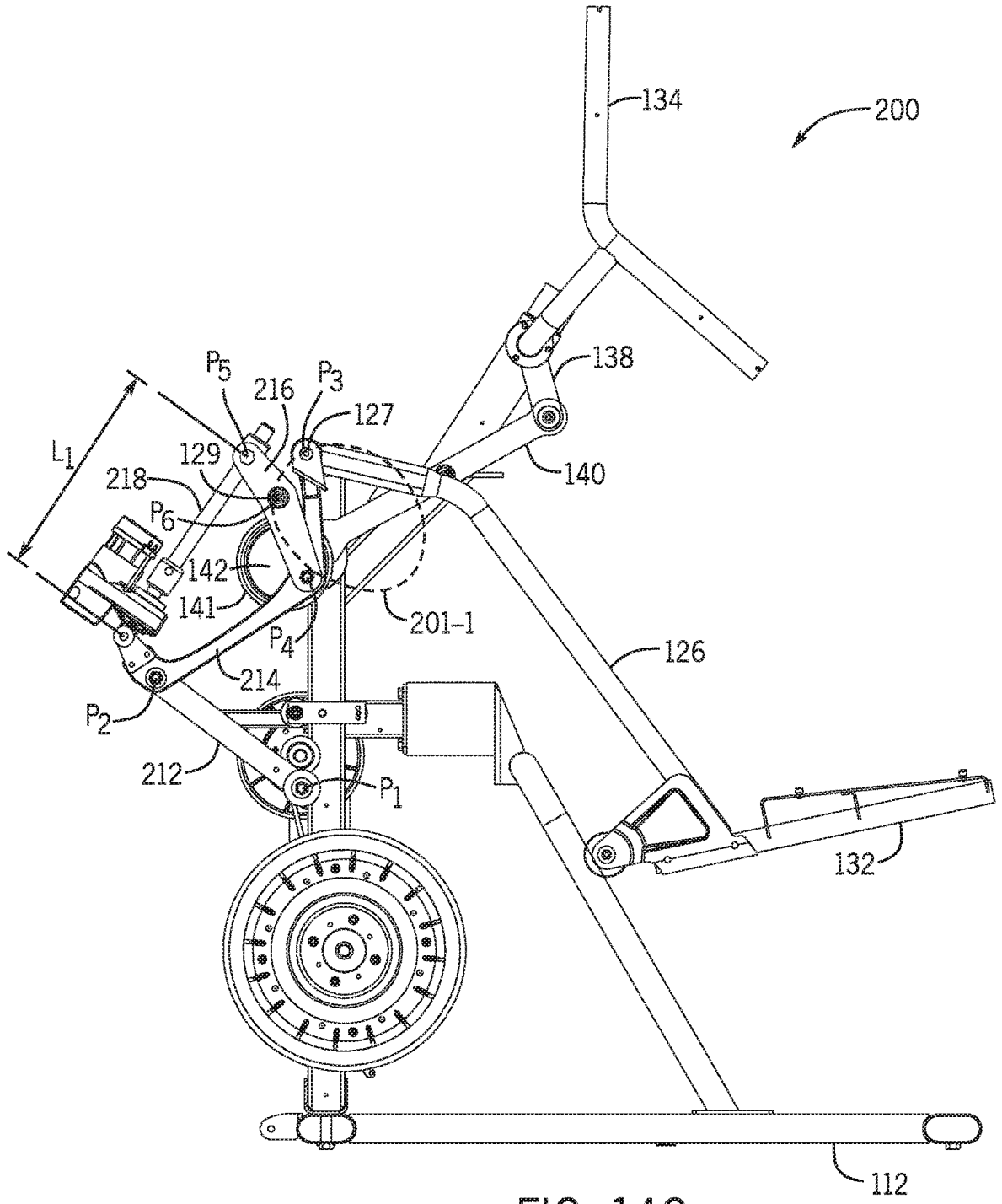
Figure 14D:
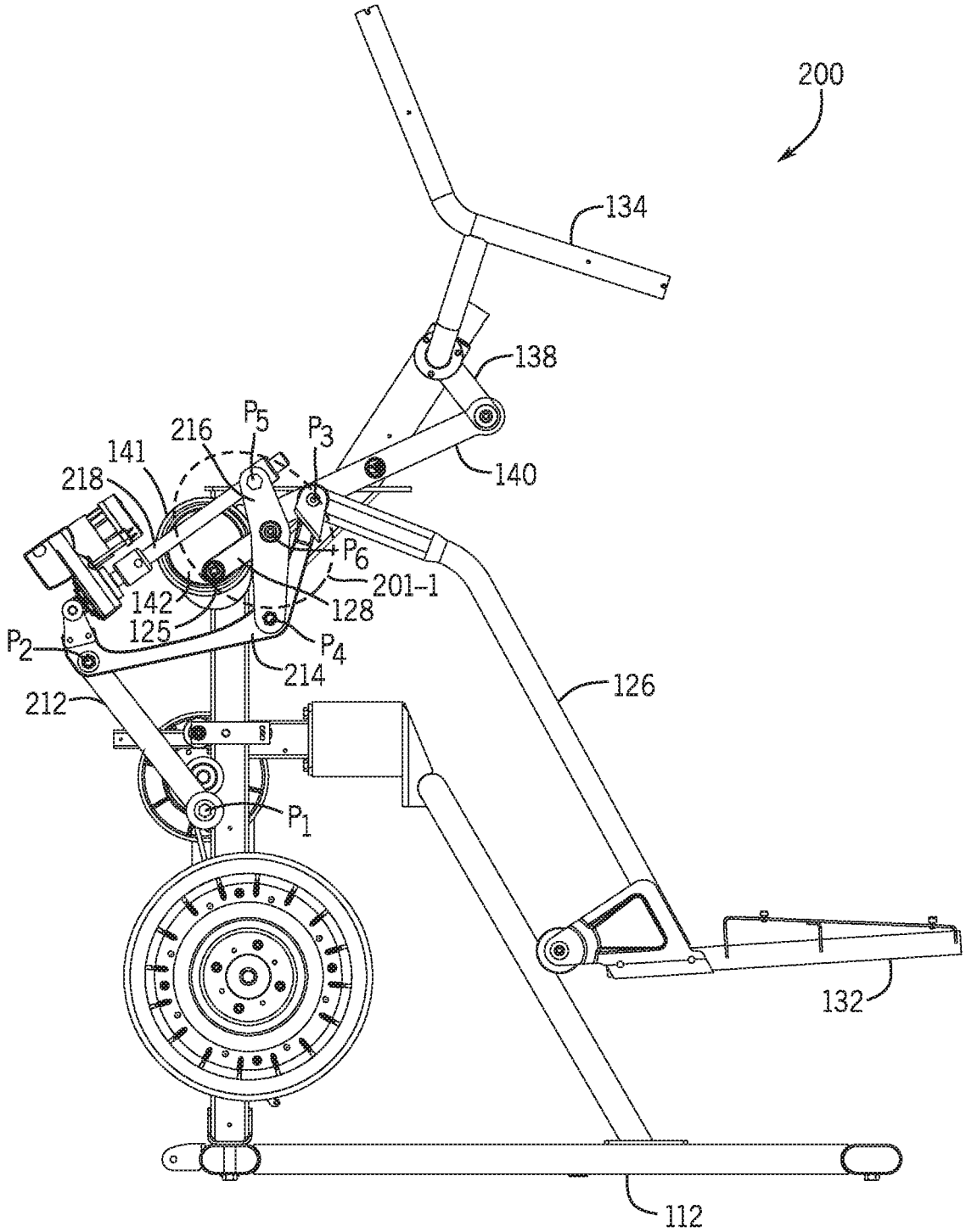

Specifically, in FIG. 14A, the output end 127 is approximately at the bottom portion of the elliptical path 201-1 (i.e., approximately at one end of the major axis), which corresponds with the lowest point of vertical travel of both the output end 127 and the pedal end of the reciprocating member 126 (also referred to as the bottom of the pedal stroke). In FIG. 14C, the output end 127 is approximately at the top portion of the elliptical path 201-1 (i.e., approximately at the opposite end of the major axis), which corresponds with the highest point of vertical travel of both the output end 127 and the pedal end of the reciprocating member 126 (also referred to as the top of the pedal stroke). As the pedal is driven to cause the output end 127 of the reciprocating member 126 to move along the path 201-1 from the bottom to the top portion and then back to the bottom portion of the path 201-1, the output end 127 passes through an intermediate point on one side of the generally elliptical path 201-1 (as shown in FIG. 14B) and then through an intermediate point on the opposite side (as shown in FIG. 14B), both of which intermediate points may correspond with the same intermediate point along the vertical travel path of the pedal end of the reciprocating member 126, which may be referred to as the middle of the stroke.

Figure 15A:
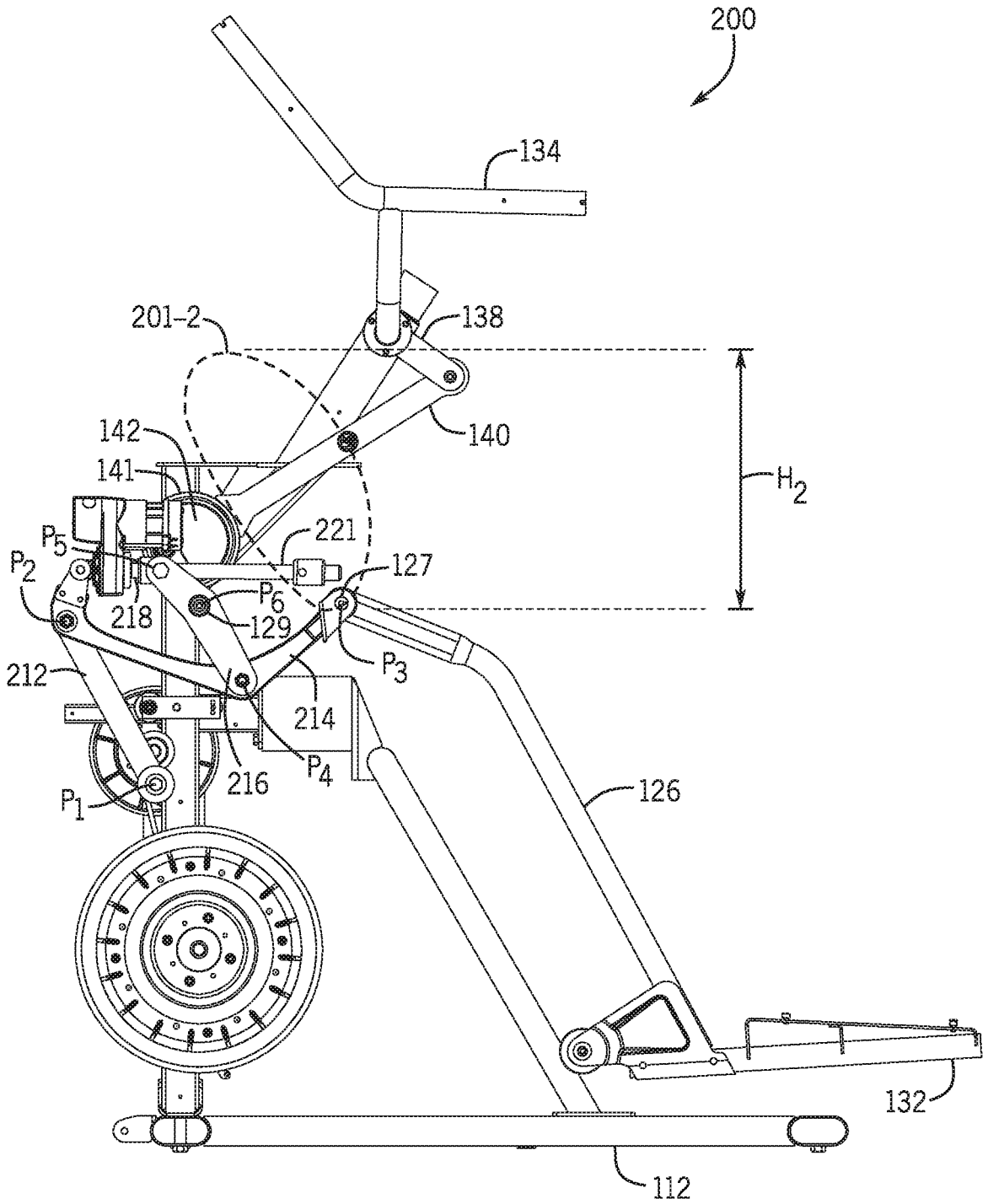
FIGS. 15A-15D are side views of the machine in FIG. 13 illustrating the positions of the linkages during a pedal stroke.
Figure 15B:
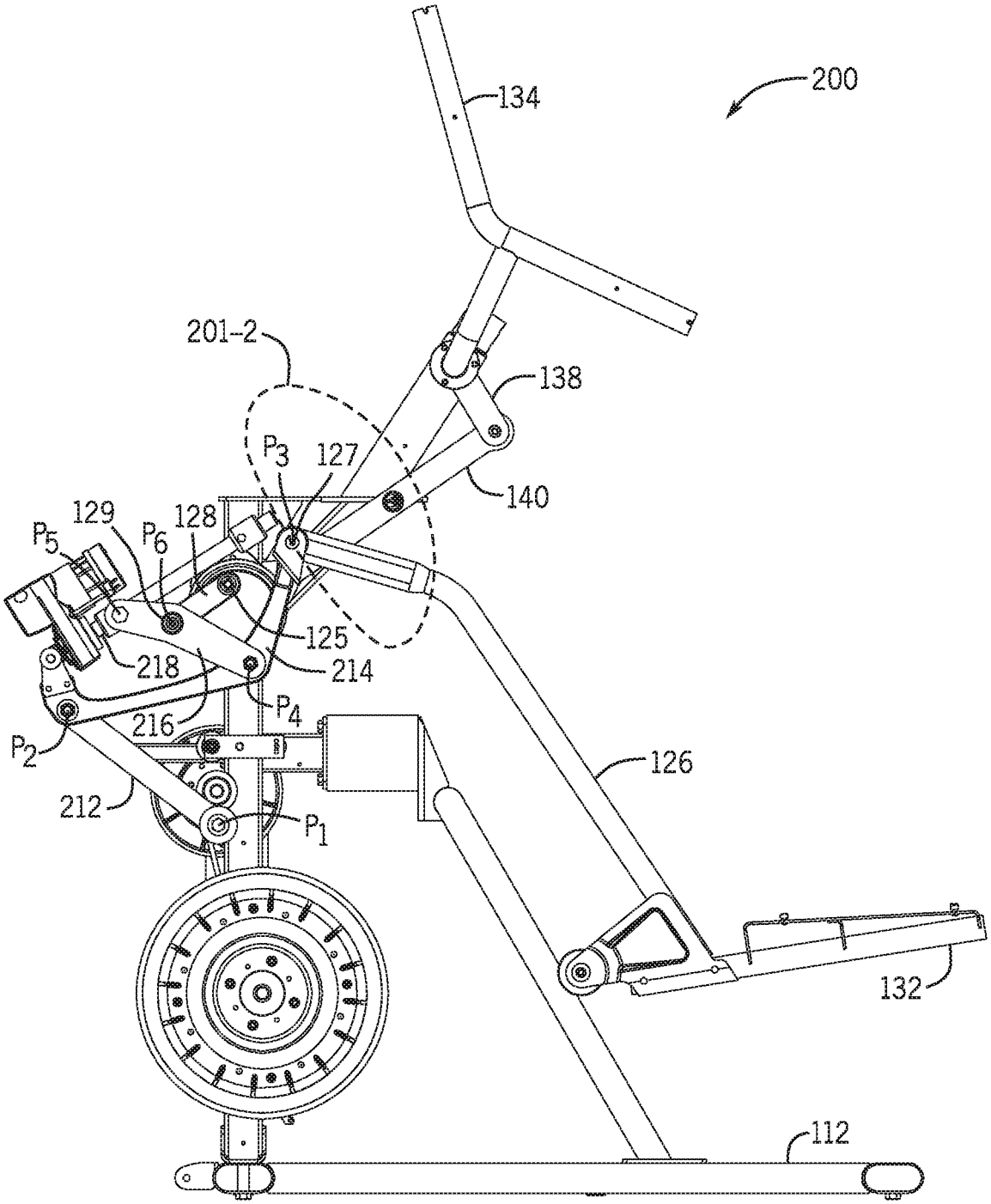
Figure 15C:
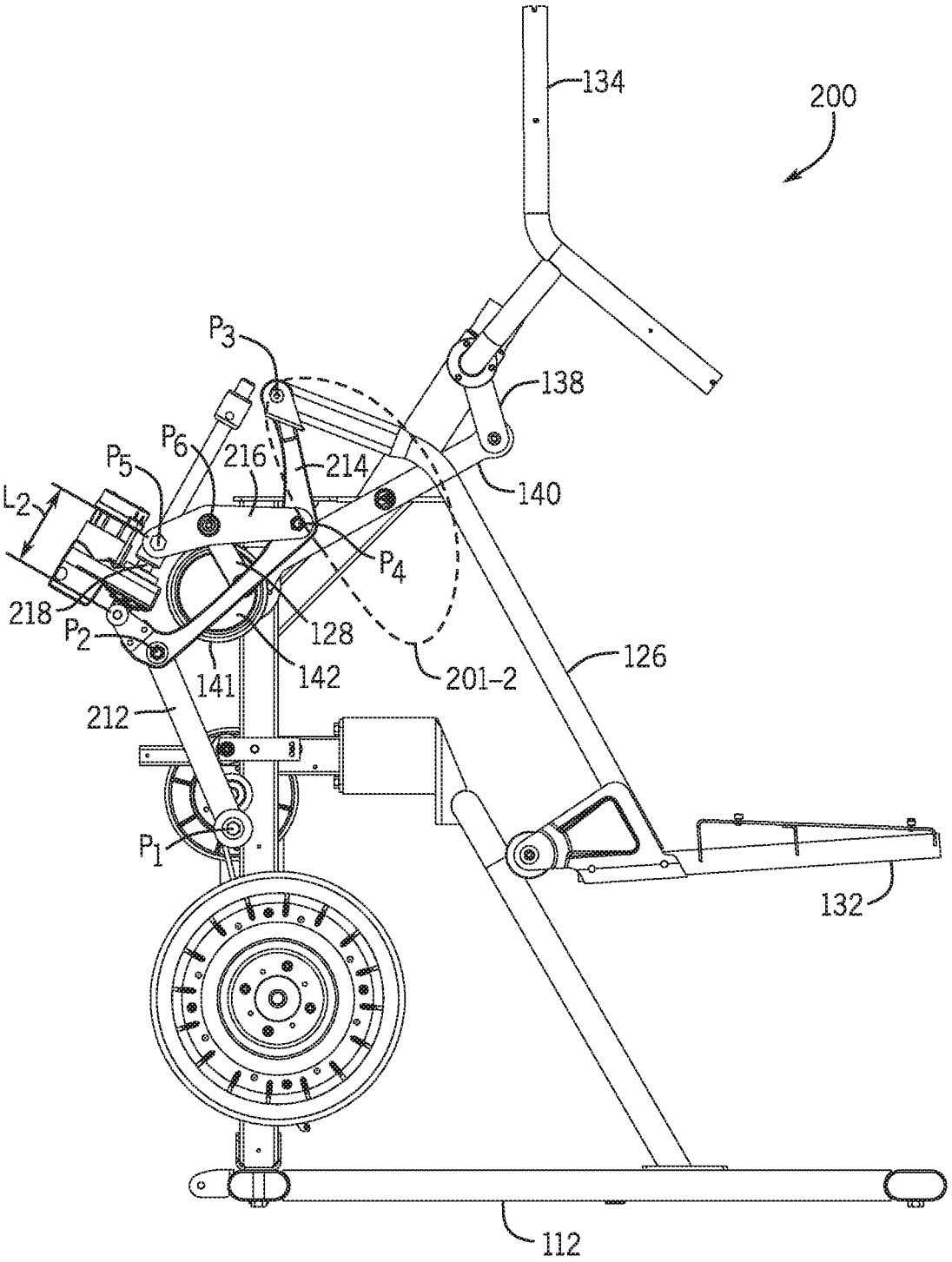
Figure 15D:
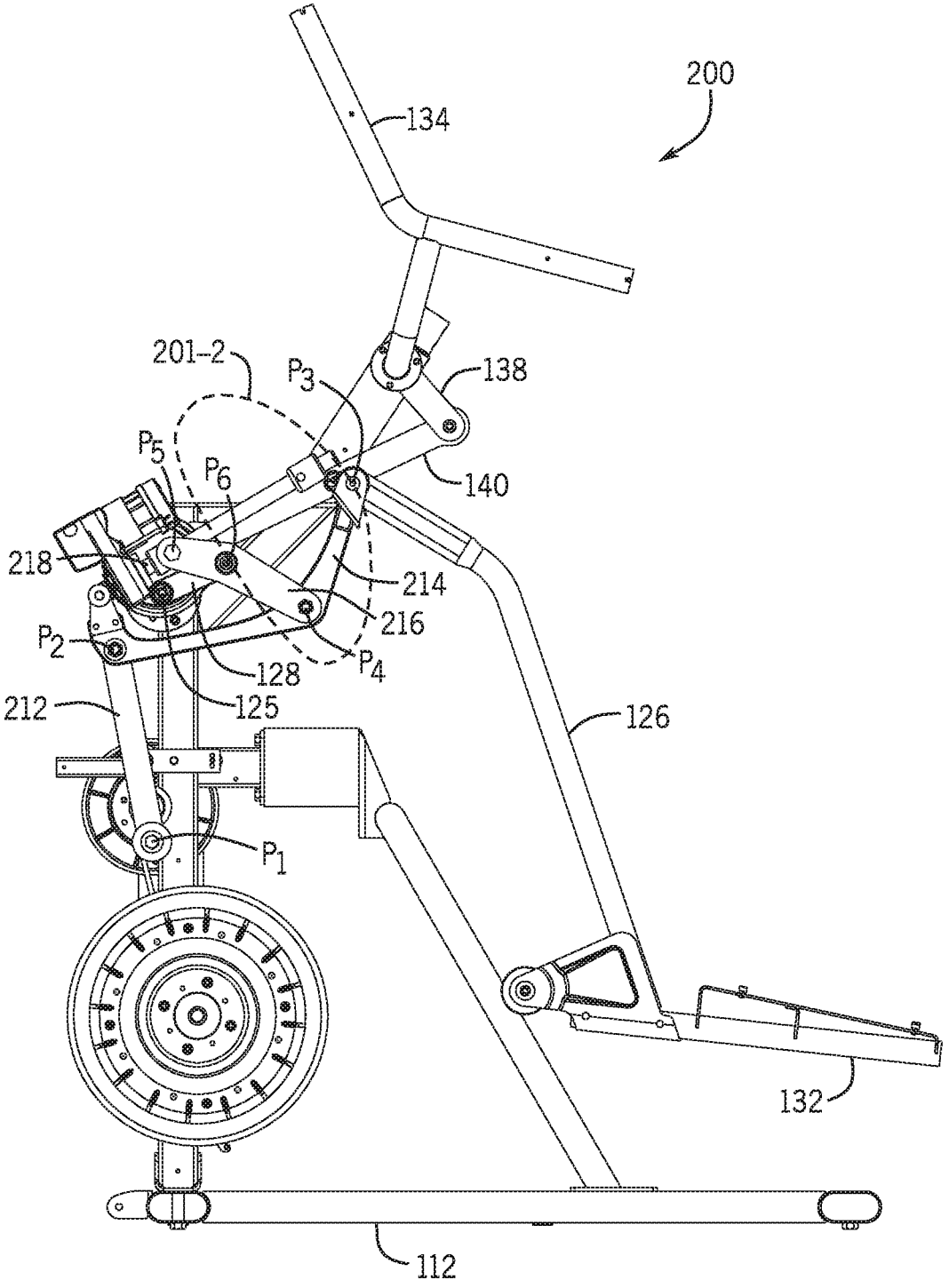
Figure 16:
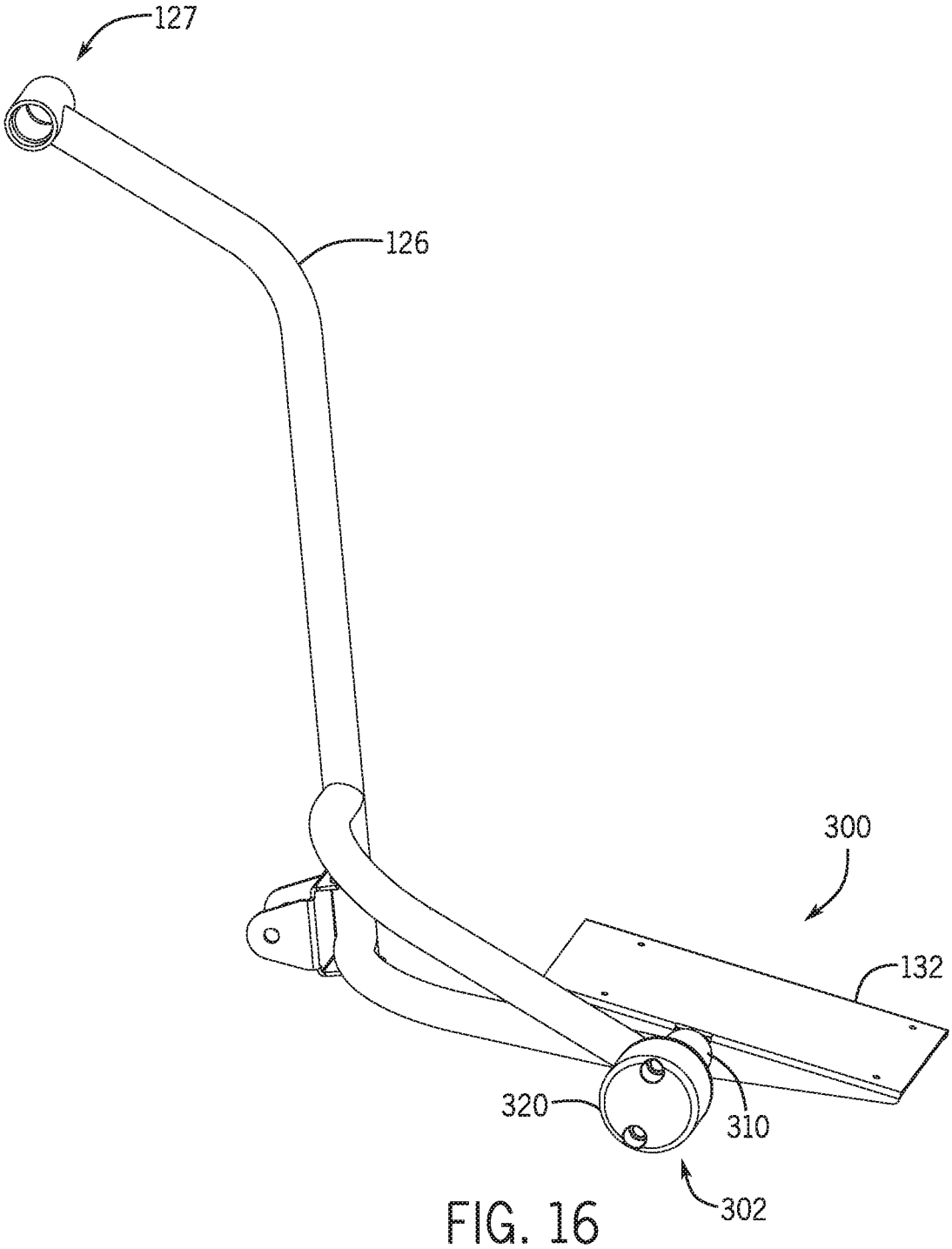
FIG. 16 is a perspective partial view of a pivoting pedal assembly connected to a lower reciprocating member for an exercise machine such as any of the machines in FIGS. 1-15.

Similar relative position and movement applies to the second illustrated stride setting in FIGS. 15A-15D in which the output end 127 traverses a generally elliptical path which is more eccentric than the elliptical path 201-1. Specifically, in FIG. 15A, the output end 127 is approximately at the bottom portion of the elliptical path 201-2, which corresponds with the lowest point of vertical travel of both the output end 127 and the pedal end of the reciprocating member 126 and may also be referred to as the bottom of the pedal stroke in this setting. In FIG. 15C, the output end 127 is approximately at the top portion of the elliptical path 201-2, which corresponds with the highest point of vertical travel of both the output end 127 and the pedal end of the reciprocating member 126 and may also be referred to as the top of the pedal stroke of this setting. As the pedal is driven to cause the output end 127 of the reciprocating member 126 to move along the path 201-2 from the bottom to the top and then back to the bottom portion of the path 201-2, the output end 127 passes through an intermediate point on one side and then the opposite side of the generally elliptical path 201-2 (as shown in FIGS. 15B and 15D), both of which intermediate points may correspond with the same intermediate point along the vertical travel path of the pedal end of the reciprocating member 126 in this setting, and which may be referred to as the middle of the stroke of this stride setting.

In these views, the pivot joints $P_1$, $P_2$, $P_3$ and $P_6$ pivot during the illustrated pedal stroke, while the pivot joints $P_4$ and $P_5$ are pivotally restrained (e.g., by the setting of the distance and angle between links 214 and 216) and thus do not pivot during the illustrated pedal stroke. The pivot joints are pivotable during an adjustment of the stride (e.g., during extension or retraction of the linear actuator 221). Once an adjustment is completed, the relative position of the links 214 and 216, including the relative angle between the links 214 and 216 and relative distance between various attachment points of the links 214 and 216 is fixed, e.g., by the selected length (e.g., $L_1$ in the short stride setting or $L_2$ in the long stride setting) of the variable length member 218. As shown, as the length of the variable length member 218 is reduced the distance between the output end 127 of the reciprocating member 126 and the input end 129 or the crank arm 128 is increased and thus the length of the stride is increased. Conversely, as the length of the variable length member 218 is increased the distance between the output end 127 of the reciprocating member 126 and the input end 129 or the crank arm 128 is decreased and thus the length of the stride is decreased. In the short stride setting (e.g., FIGS. 14A-14D), as the pedal 132 is driven by a user, the output end 127 of the reciprocating member 126, which coincides with the pivot joint $P_3$, traverses a generally elliptical path 201-1, which corresponds to a first displacement $H_1$ of the output end in the vertical direction. In the long stride setting (e.g., FIGS. 15A-15D), as the pedal 132 is driven by a user, the output end 127 of the reciprocating member 126, coinciding with the pivot joint $P_3$, traverses the generally elliptical path 201-, which corresponds to a second larger displacement $H_2$ of the output end in the vertical direction.

FIGS. 16-20 show views of a pedal assembly 300 in accordance with one example of the present disclosure. The pedal assembly 300 may be incorporated in a lower linkage of an exercise machine according to any of the embodiments herein. For example, the pedal assembly 300 may be incorporated in the lower linkage 92 of machine 100 or the lower linkage 192 of machine 200. The pedal assembly 300 may include a pivotal interface 302 which pivotally couples a pedal 132 to a foot link 126. In some embodiments, the pedal 132 may be resiliently pivotally coupled to the foot link 126 via the pivotal interface 302.

Figure 17:
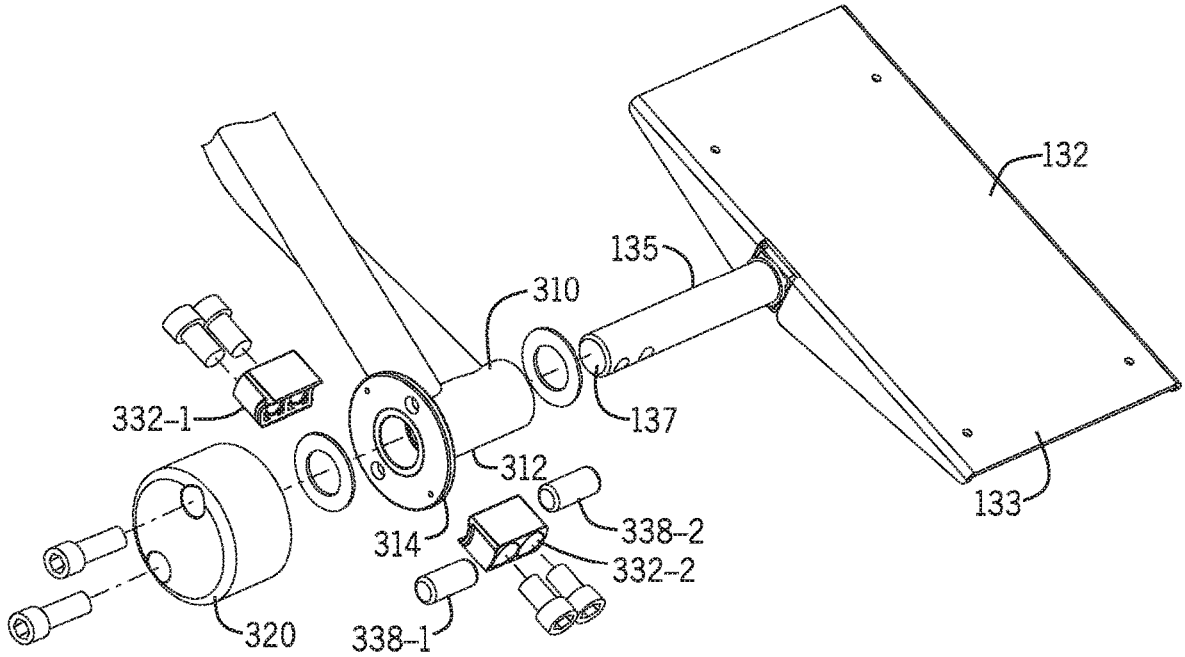
FIG. 17 is an exploded view of the pivoting pedal assembly of FIG. 16.
Figure 18:
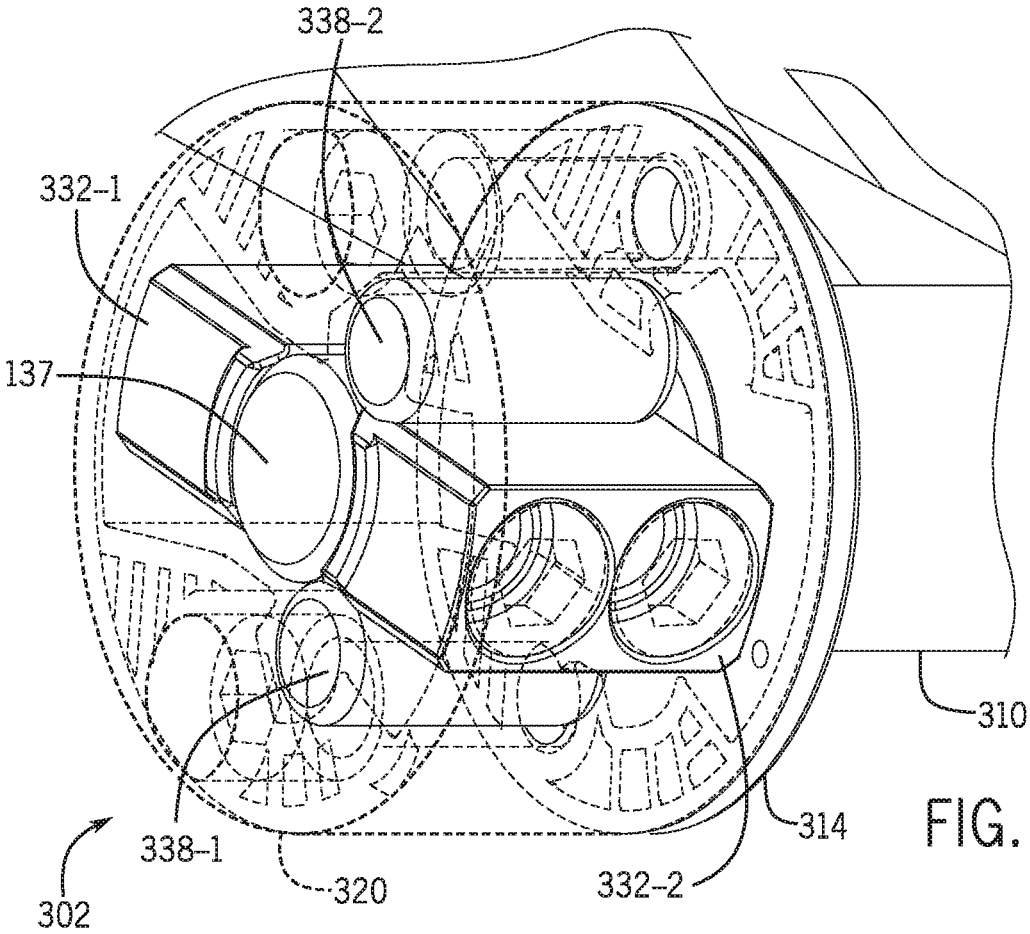
FIG. 18 is a partial assembled view of the pivoting pedal assembly of FIG. 17.

As shown in the exploded view in FIG. 17, the pedal 132 may include a footplate 133. The footplate 133 may be configured to support a foot of the user during use of the exercise machine (e.g., machine 200). A shaft 135 may be rigidly attached to and extend (e.g., perpendicularly) from a side of the footplate 133. The shaft 135 may be rotatably coupled to the input end of the reciprocating member 126, for example via a bearing 310 configured to rotatably support the pedal 132 on the reciprocating member 126. The bearing 310 may be rigidly attached to the input end of the reciprocating member 126 and may include a cylindrical housing 312 configured to receive the shaft 135 at least partially therein.

The shaft 135 may be longer than the cylindrical housing 312, thus a portion of the shaft 135 (e.g., free end portion 137 or simply end portion 137) opposite the footplate 133 may extend from a side of the cylindrical housing 312 opposite the footplate 133. The cylindrical housing 312 may include a flange 314 on the side of the housing opposite the footplate 133 (e.g., proximate the end portion 137), thus the end portion 137 of the shaft 135 may extend beyond the flange 314.

Figure 20:
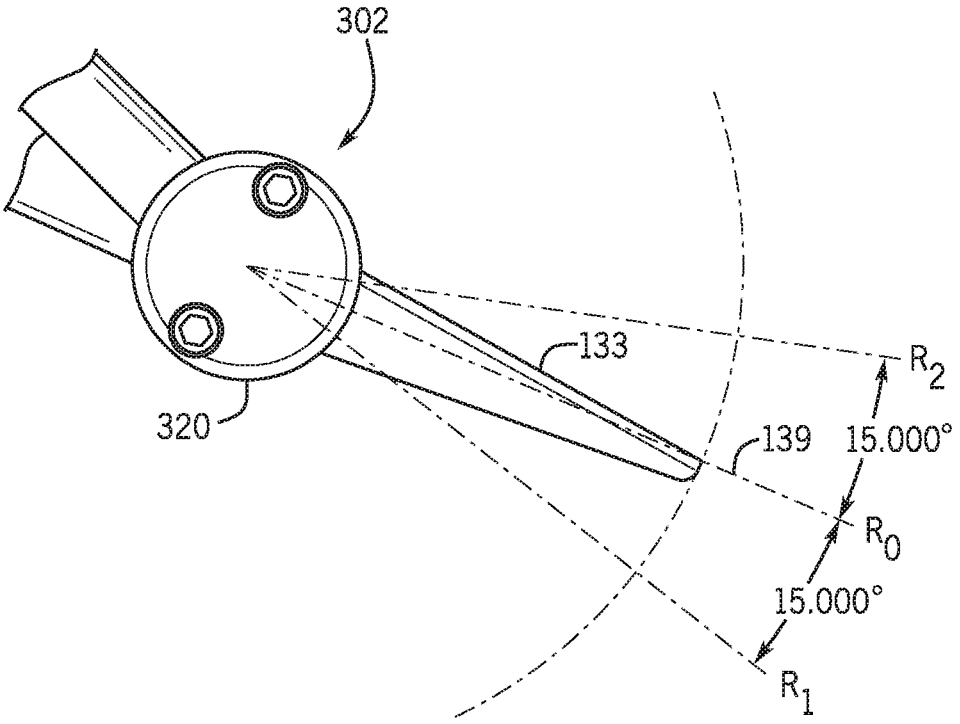
FIG. 20 is a partial side view of the pivoting pedal assembly showing an example pivoting range of the pedal of FIGS. 16 and 17.

The pivotal interface 302 may include a spring assembly configured to bias the footplate 133 toward a neutral position. For example, the spring assembly may include one or more resilient members (e.g., rods 338-1 and 338-2, portions of cap 320, or combinations thereof), which operatively engage the shaft of the pedal 132 and operate on the shaft of the pedal 132 to bias the footplate 133 toward a neutral position. In the illustrated embodiment, first and second extension blocks 332-1 and 332-2, respectively, are each attached (e.g., fastened) to the shaft 135, specifically to the end portion 137, at radially opposite locations of the shaft 135. The extension blocks 332-1 and 332-2 may be arranged such that they lie in a plane parallel to the plane of the foot plate. Thus, the extension blocks 332-1 and 332-2 may function as an extension to the plane of the footplate 133 on the opposite side of the bearing 310. Pivotal action of the footplate 133 (e.g., pivoting of the plane of the footplate) may thus be limited by operation of a biasing force on the extension blocks 332-1, 332-2. For example, as shown in FIG. 20, pivoting of the plane 139 of the footplate may be limited to a predetermined amount, for example up to plus or minus approximately 15 degrees (e.g., as shown by positions $R_1$ and $R_2$) from the neutral position $R_0$.

Figure 19:
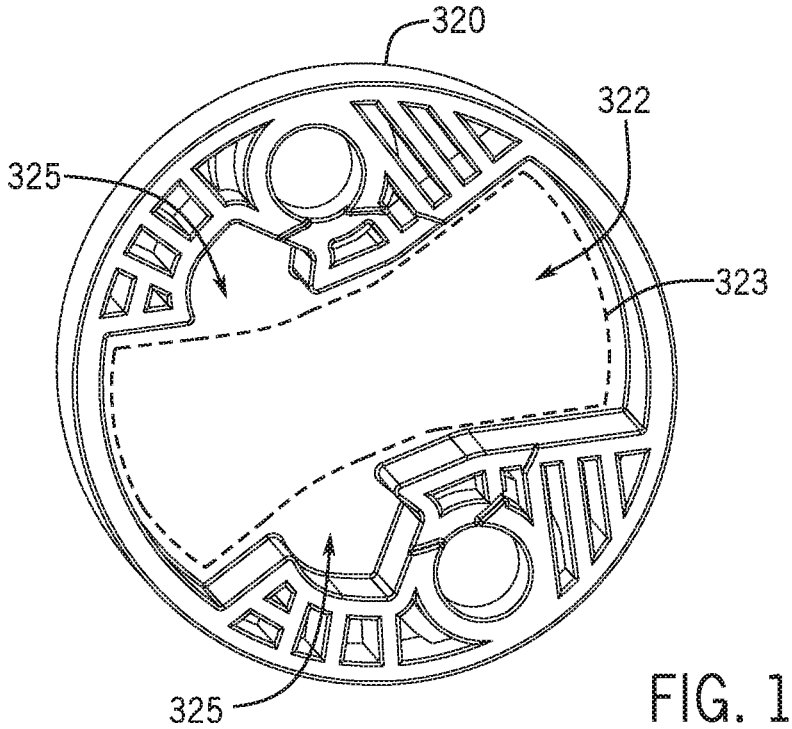
FIG. 19 is a view of the resilient bearing of the pivoting pedal assembly of FIG. 17.

The pivotal interface 302 may include a cap 320 connected to the bearing 310 on the side of the bearing opposite the footplate 133. Referring now also to FIG. 19, the cap 320 may be implemented using a shaped block which defines at least one cavity 322. The cavity 322 may include a block receiving portion 323, which may be shaped to accommodate the first and second extension blocks 332-1 and 332-2 at least partially therein. The cavity 322 may be open to the side of the cap 320 facing the flange 314 (see e.g., FIG. 18), such that at least part of the extension blocks 332-1 and 332-2 may be inserted into the block receiving portion 323. The block receiving portion 323 may be slightly larger, e.g., at its perimeter, to allow the extension blocks 332-1 and 332-2 to move, e.g., pivot, within the block receiving portion 323.

The cap 320 may be configured to limit movement of the pedal 132 in relation to the reciprocating member 126. For example, the cavity 322 may be configured to limit rotational movement of the extension blocks 332-1 and 332-2 in relation to the cylindrical housing thereby limiting the movement of the pedal 132 in relation to the reciprocating member 126. In some examples, the cap 320 may enclose and/or be integrally formed with one or more resilient members arranged to apply a biasing force on the pedal 132 to resist rotation of the pedal 132 away from its neutral position. The one or more resilient members may include separate components (e.g., the rods 338-1, 338-2) which may operate to apply a biasing force on the extension blocks 332-1, 332-2 during movement of the pedal to bias the pedal towards its neutral position. In some embodiments, the cavity 322 may include a rod receiving portions 325 on opposite sides of the block receiving portion 323. The rod receiving portions 325 may be shaped to accommodate each of the rods 338-1 and 338-2. The rods 338-1 and 338-2 may function as limiters, that is, operate to limit pivotal movement of the extension blocks 332-1 and 332-2 within the cavity 322. In some embodiments, the one or more resilient members may include a portion of the cap itself (e.g., one or more walls of the cavity 322), which may be formed of resilient material and may thus apply a biasing force on the extension blocks 332-1, 332-2 during movement of the pedal.

One or more components of the pivotal interface 302 may be removably connected to the reciprocating member 126, such as to enable maintenance and replacement. For example, the cap 320 may be removably connected to the bearing 310 via fasteners. In some examples, the rods 338-1, 338-2 may be removably coupled to the cap 320, for example to enable replacement of the cap and/or the rods (e.g., with rods of different stiffness) and/or enable replacement of worn out or otherwise damaged parts. In some embodiments, the rods may be irremovably connected to the cap 320, e.g., integrally formed with the cap. In such embodiments, the cap 320 may not include rod receiving portions 325 but may instead bodily incorporate the rods into the shape of the cap (e.g., around the perimeter of the cavity 322).

Further inventive examples in accordance with the present disclosure are described in the following enumerated paragraphs:

A1. A stationary exercise machine comprising:

a frame;

a crankshaft connected to the frame and rotatable about a crank axis;

first and second upper reciprocating members, each of the first and second upper reciprocating members operatively associated with the crankshaft via a collar that encompasses a disk eccentrically mounted on the crankshaft;

first and second crank arms, each of the first and second crank arms rigidly connected to opposite side of the crankshaft, wherein rotation of either of the first or second crank arm causes rotation of the crankshaft; and first and second lower linkages, wherein each of the first and second lower linkages is operatively connected to the crankshaft and to a respective one of first and second pedals, wherein each of the first and second lower linkages includes a reciprocating member operatively connecting the respective one of the pedals with respective one of the crank arms, wherein each of the first and second lower linkages further includes an adjustable linkage connected between the reciprocating member and the respective crank arm, the adjustable linkage operable to vary a distance between an output end of the reciprocating member and an input end of the crank arm.

A2. The exercise machine according to paragraph A1, wherein the adjustable linkage includes at least three links pivotally coupled to one another and a variable length member coupled to at least two of the at least three links and operable to change a distance between the at least two links.

A3. The exercise machine according to paragraph A1, wherein the adjustable linkage includes a first link pivotally connected to the frame, a second link pivotally connected to the first link and to the reciprocating foot member, a third link pivotally connected to the second link and the crank arm, and wherein the variable length member is connected to the second link and the third link.

A4. The stationary exercise machine according to paragraph A1, wherein the variable length member comprises a linear actuator operatively associated with a motor configured to drive the linear actuator.

A5. The stationary exercise machine according to any of paragraphs A1 through A4, wherein each of the first and second pedals is pivotally coupled to a respective one of the first and second lower linkages.

A6. The stationary exercise machine according to any of paragraphs A1 through A5 further comprising first and second handles each operatively associated with the frame and the first and second upper reciprocating members, respectively.

A7. The exercise machine according to any of paragraphs A1 through A6 further comprising a resistance mechanism operatively arranged to resist rotation of the crankshaft.

B1. A stationary exercise machine comprising:

a frame;

a crankshaft connected to the frame and rotatable about a crank axis;

first and second crank arms each rigidly connected to opposite sides of the crankshaft, wherein rotation of either of the first or second crank arm causes rotation of the crankshaft;

first and second lower linkages each operatively connected to the crankshaft and to respective first and second pedals, wherein each of the first and second lower linkages includes a reciprocating member operatively connecting respective one of the pedals with respective one of the crank arms, wherein each of the first and second lower linkages further includes an adjustable linkage connected between the reciprocating member and the respective crank arm, wherein each of the adjustable linkages includes at least three links pivotally coupled to one another and further includes a variable length member coupled to at least two links of the at least three links and operable to change a distance between the at least two links, and wherein the first and second pedals are each pivotally connected to the respective one of the first and second lower linkages.

B2. The stationary exercise machine according to paragraph B1, wherein each of the left and right pedals is resiliently pivotally connected to the respective one of the left and right lower linkages.

B3. The stationary exercise machine according to paragraph B1, wherein each of the left and right pedals includes a footplate and a shaft extending from a side of the footplate, and wherein the shaft is received in a bearing coupled to the lower linkage.

B4. The stationary exercise machine according to paragraph B3 further comprising a spring assembly operatively associated with the bearing to bias the footplate toward a neutral position.

B5. The stationary exercise machine according to paragraph B4, wherein the shaft includes an end portion which extends from a side of the bearing opposite the footplate, and wherein stationary exercise machine further comprises:

extension blocks attached to the end portion at radially opposite locations around the end portion;

a cap defining a cavity configured to accommodate the end portion and the extension blocks; and limiters operatively associated with the cap to resist movement of the extension blocks the cavity.

B6. The stationary exercise machine according to paragraph B5, wherein the limiters comprise a pair of resilient rods located within the cavity on opposite sides of one of the extension blocks.

B7. The stationary exercise machine according to paragraph B4, wherein the spring assembly is configured to limit rotation of the footplate to about 15 degrees from the neutral position.

C1. A stationary exercise machine comprising:

a frame;

a crankshaft supported by the frame;

a foot link operatively associated with the crankshaft and the frame; and a pedal pivotally joined to the foot link via a pedal assembly;

wherein the pedal comprises a foot plate and a shaft extending from the footplate, and wherein the pedal assembly comprises a spring assembly operatively coupled to the shaft and configured to bias the foot plate toward a neutral position.

C2. The stationary exercise machine according to paragraph C1, wherein the pedal assembly comprises a bearing rigidly coupled to the foot link and configured to receive at least a portion of the shaft.

C3. The stationary exercise machine according to paragraph C2, wherein an end portion of the shaft extends from a side of the bearing opposite the foot plate.

C4. The stationary exercise machine of claim C3, wherein the spring assembly includes a cap enclosing, at least partially, the end portion of the shaft.

C5. The stationary exercise machine of claim C4, wherein the spring assembly further comprises extension blocks attached to the end portion at radially opposite locations of the end portion, wherein the cap defines a cavity configured to receive, at least partially therein, the end portion and the extension blocks.

C6. The stationary exercise machine of claim C5, wherein the spring assembly further comprises limiters operatively associated with the cap to resist movement of the extension blocks within the cavity.

C7. The stationary exercise machine of claim C5, wherein the limiters comprise a pair of resilient rods removably positioned in the cavity on opposite sides of at least one of the extension blocks.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A pedal assembly for a stationary exercise machine, the pedal assembly comprising:

a foot plate configured to support a foot of a user of the stationary exercise machine;

a shaft coupled to a movable component of the stationary exercise machine and having a shaft axis oriented transversely to a toe-heel direction of the foot plate, wherein the shaft rotatably couples the foot plate, to the movable component such that the foot plate is rotatable about the shaft axis; and at least one resilient member operatively engaged with the shaft to bias the foot plate toward a neutral position by resisting rotation of the foot plate in at least one of a clockwise direction or a counterclockwise direction about the shaft axis.

2. The pedal assembly of claim 1, wherein the shaft is rigidly coupled to the foot plate.

3. The pedal assembly of claim 2, wherein the shaft extends from a side of the foot plate.

4. The pedal assembly of claim 1, wherein the shaft is received in a bearing rigidly coupled to the movable component of the stationary exercise machine.

5. The pedal assembly of claim 4, wherein the bearing comprises a cylindrical housing that receives the shaft at least partially therein to rotatably couple the shaft to the movable component.

6. The pedal assembly of claim 5, wherein an end portion of the shaft extends from a side of the bearing opposite the foot plate.

7. The pedal assembly of claim 6, Wherein the at least one resilient member is housed in a cap enclosing, at least partially, the end portion of the shaft.

8. The pedal assembly of claim 7, wherein the at least one resilient member is received in a cavity defined by the cap.

9. The pedal assembly of claim 8, wherein the pedal assembly further comprises extension blocks attached to the end portion at radially opposite locations of the end portion, the extension blocks configured to bear on the at least one resilient member for biasing the foot plate toward the neutral position.

10. The pedal assembly of claim 9, wherein the extension blocks are received within the cavity of the cap.

11. The pedal assembly of claim 8, wherein the at least one resilient member comprises a pair of resilient members arranged on opposite sides of the shaft.

12. The pedal assembly of claim 11, wherein each of the pair of resilient members is a rod formed of a resilient material.

13. The pedal assembly of claim 8, wherein the at least one resilient member limits a pivotal movement of the foot plate to about 15 degrees from the neutral position.

14. The pedal assembly of claim 7, further comprising a flange attached to an end of the cylindrical housing at a side of the cylindrical housing opposite the foot plate such that the end portion of the shaft extends beyond the flange.

15. The pedal assembly of claim 14, wherein the cap is connected to the flange.

16. The pedal assembly of claim 15, wherein the cap is removably connected to the flange.

17. A stationary exercise machine comprising at least one pedal assembly according to claim 1.

18. A pedal assembly for an exercise machine comprising:

a foot plate;

a shaft coupling the foot plate to a reciprocating member of the exercise machine;

a cylindrical housing rigidly attached to the reciprocating member, wherein the shaft is rotatably received within the cylindrical housing such that an end portion of the shaft extends beyond the cylindrical housing in a direction opposite the foot plate;

a cap adjacent to a side of the cylindrical housing opposite the foot plate, wherein the cap defines a cavity that received the end portion of the shaft; and at least one resilient member arranged in the cavity and operatively engaged with the end portion of the shaft to bias the foot plate toward a neutral position.

19. A stationary exercise machine comprising:

a frame;

left and right linkages, each comprising a plurality of movable links operatively connected to one another to form the respective linkage, wherein each of the left and right linkages is supported on a respective side of the frame and configured to be driven by a user; and left and right pedal assemblies, each associated with a respective one of the left and right linkages and each comprising:

a foot plate configured to support a foot of a user of the stationary exercise machine, a shaft coupled to a first link of the plurality of movable links, wherein the shaft has a shaft axis oriented transversely to a toe-heel direction of the foot plate such that the foot plate is rotatable with the about the shaft axis; and a biasing assembly comprising a first resilient member and a second resilient member each operatively engaged with the shaft to resist rotation of the foot plate in clockwise and counterclockwise directions about the shaft axis, thereby biasing the foot plate toward a neutral position.

20. The stationary exercise machine of claim 19 further comprising a crankshaft pivotally supported by the frame and rotatable about a crank axis, and wherein the plurality of movable links comprises:

left and right crank arms each rigidly connected to opposite sides of the crankshaft such that rotation of either of the first or second crank arm causes rotation of the crankshaft; and left and right lower reciprocating members, each operatively connected to a respective one of the left and right crank arms, wherein each of the left and right lower reciprocating members supports a respective pedal assembly pivotally joined to the respective lower reciprocating member.

* * * * *